US005839411A

United States Patent [19]

Schoell

[11] Patent Number: 5,839,411

[45] Date of Patent: Nov. 24, 1998

[54] ROTARY FUEL PUMP AND COMBINATION FUEL INJECTOR/SPARK PLUG

[76] Inventor: Harry Schoell, 2698 SW. 23rd Ave., Fort Lauderdale, Fla. 33312

[21] Appl. No.: 198,434

[22] Filed: Feb. 17, 1994

Related U.S. Application Data

[63] Continuation-in-part of Ser. No. 48,821, Apr. 16, 1993, Pat. No. 5,315,967.

[51] Int. Cl.[6] ..... F02M 47/00; F02M 59/02; F02M 61/08

[52] U.S. Cl. ..... 123/446; 123/500; 239/533.7

[58] Field of Search ..... 123/446, 447, 123/496, 500, 501, 504, 508, 509; 239/533.3, 533.7, 533.8, 533.9

[56] References Cited

U.S. PATENT DOCUMENTS

| | | | |
|---|---|---|---|
| 1,775,635 | 9/1930 | Ball | 123/54.3 |
| 1,830,046 | 11/1931 | White | 123/54.3 |
| 1,934,108 | 11/1933 | Walker | 123/500 |
| 2,020,624 | 11/1935 | Thaheld | 123/501 |
| 3,482,554 | 12/1969 | Marthins | 123/54.4 |
| 3,572,209 | 3/1971 | Aldridge | 91/188 |
| 4,331,108 | 5/1982 | Collins | 123/50 R |
| 4,350,301 | 9/1982 | Erwin et al. | 239/533.7 |
| 4,408,577 | 10/1983 | Killian | 123/53.6 |
| 4,974,553 | 12/1990 | Murray et al. | 123/44 B |

FOREIGN PATENT DOCUMENTS

| | | | |
|---|---|---|---|
| 39964 | 3/1984 | Japan | 123/501 |
| 32490 | 4/1934 | Netherlands | 123/500 |

*Primary Examiner*—Willis R. Wolfe
*Attorney, Agent, or Firm*—Brooks & Kushman P.C.

[57] ABSTRACT

A rotary fuel pump and fuel injectors including a combination spark plug/fuel injector are described. The rotary fuel pump includes a camshaft carrying an eccentric cam. A plurality of rocker arms follow the cam and cause a plurality of plungers in fuel pumps to reciprocate pumping fluid with each plunger stroke. The rocker arms may include cooperating radially inner and outer rocker arms interposed between the eccentric cam and the plungers and having pivots which may be moved with respect to one another to varying the displacement of the plunger strokes. The fuel injector includes a housing having a plunger bore and a fuel inlet bore in fluid communication with one another. A plunger reciprocates within the plunger bore and has a valve seat is biased closed against a valve seat on the housing by elastomeric O-rings. The O-rings seal between the plunger and the plunger bore. Pressurized fluid pressing upon the plunger may overcome the bias allow fuel to sprayed from the plunger bore. An insulator may be provided between the housing and the plunger and with a fuel inlet bore connecting the fuel bore of the housing with the plunger bore. Electrical current and pressurized fuel may be supplied to the fuel injector to causing the fuel to be sprayed from the plunger bore and a spark to be produce across a spark gap formed between the housing and plunger.

11 Claims, 15 Drawing Sheets

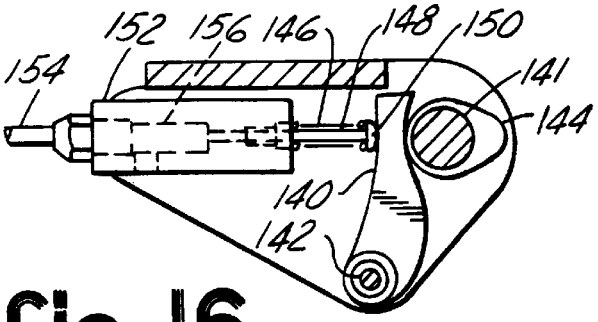
Fig-16
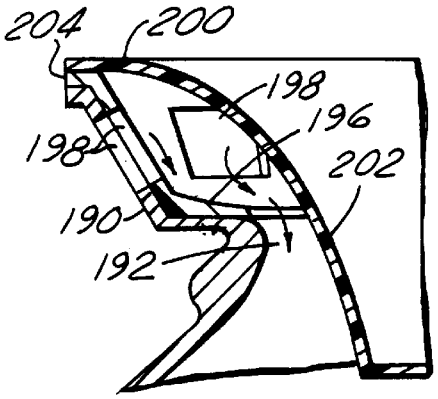
Fig-19
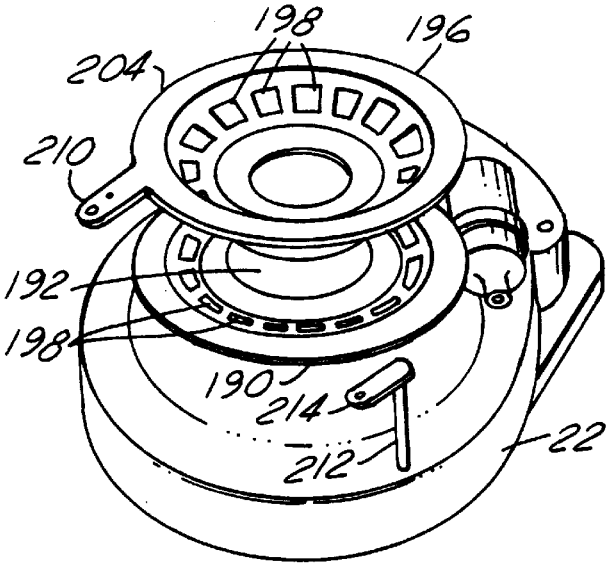
Fig-17
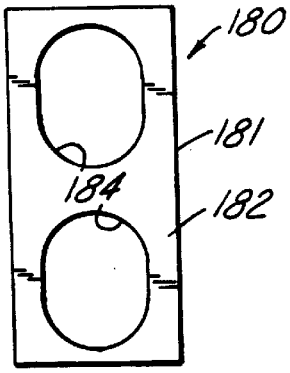
Fig-20
Fig-21
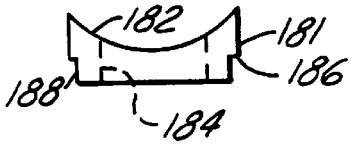
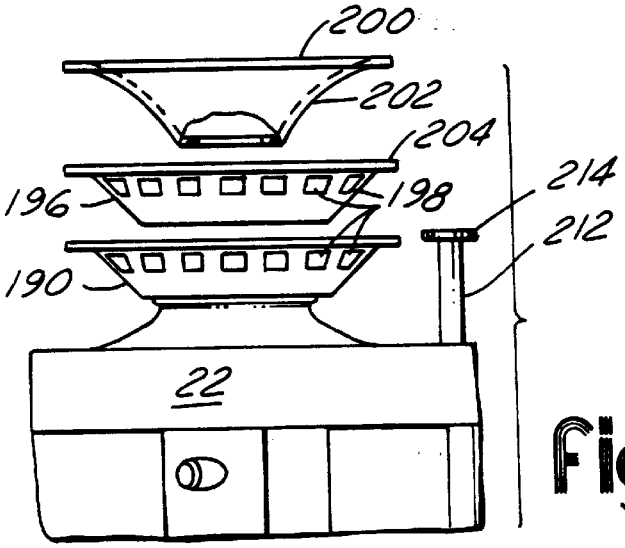
Fig-18

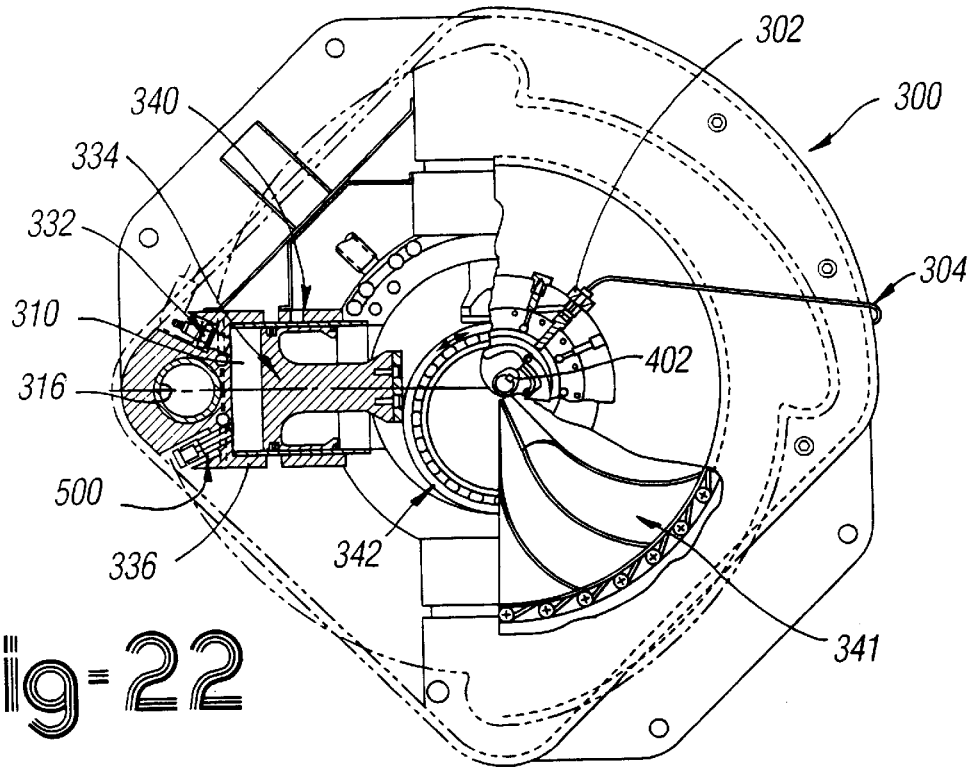
Fig-22
Fig-23
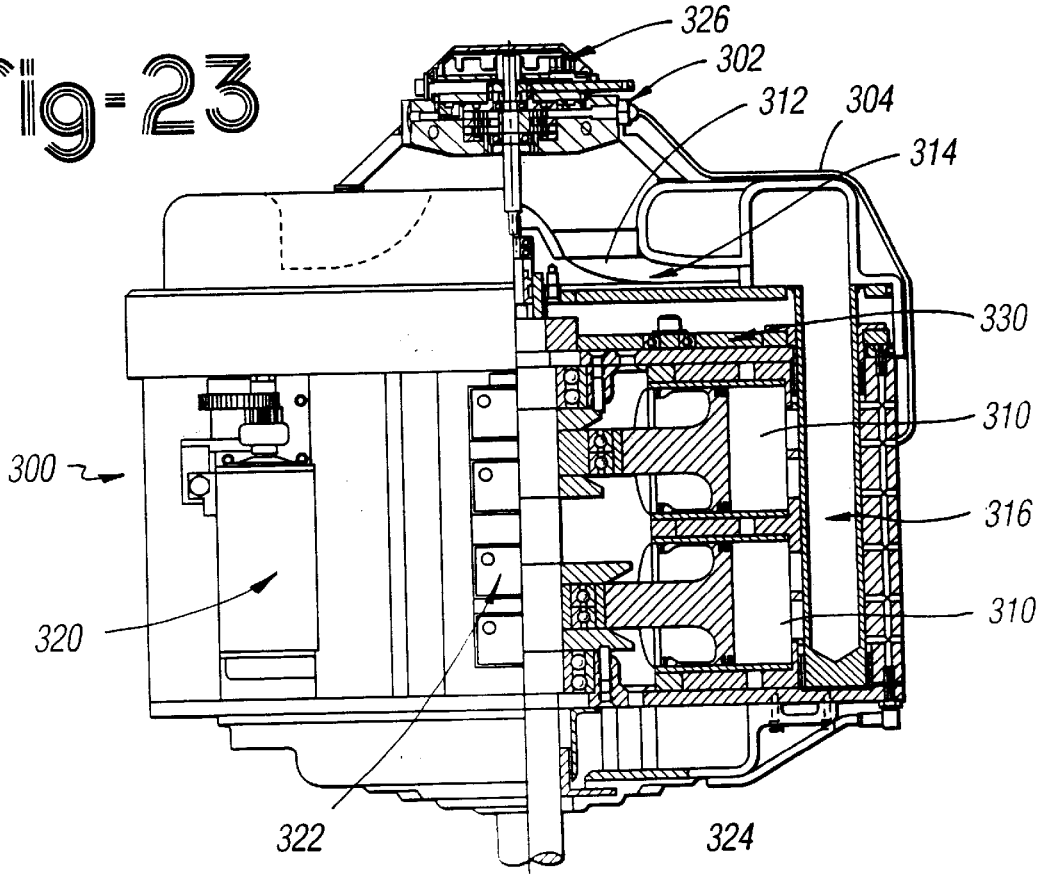

Fig-26a
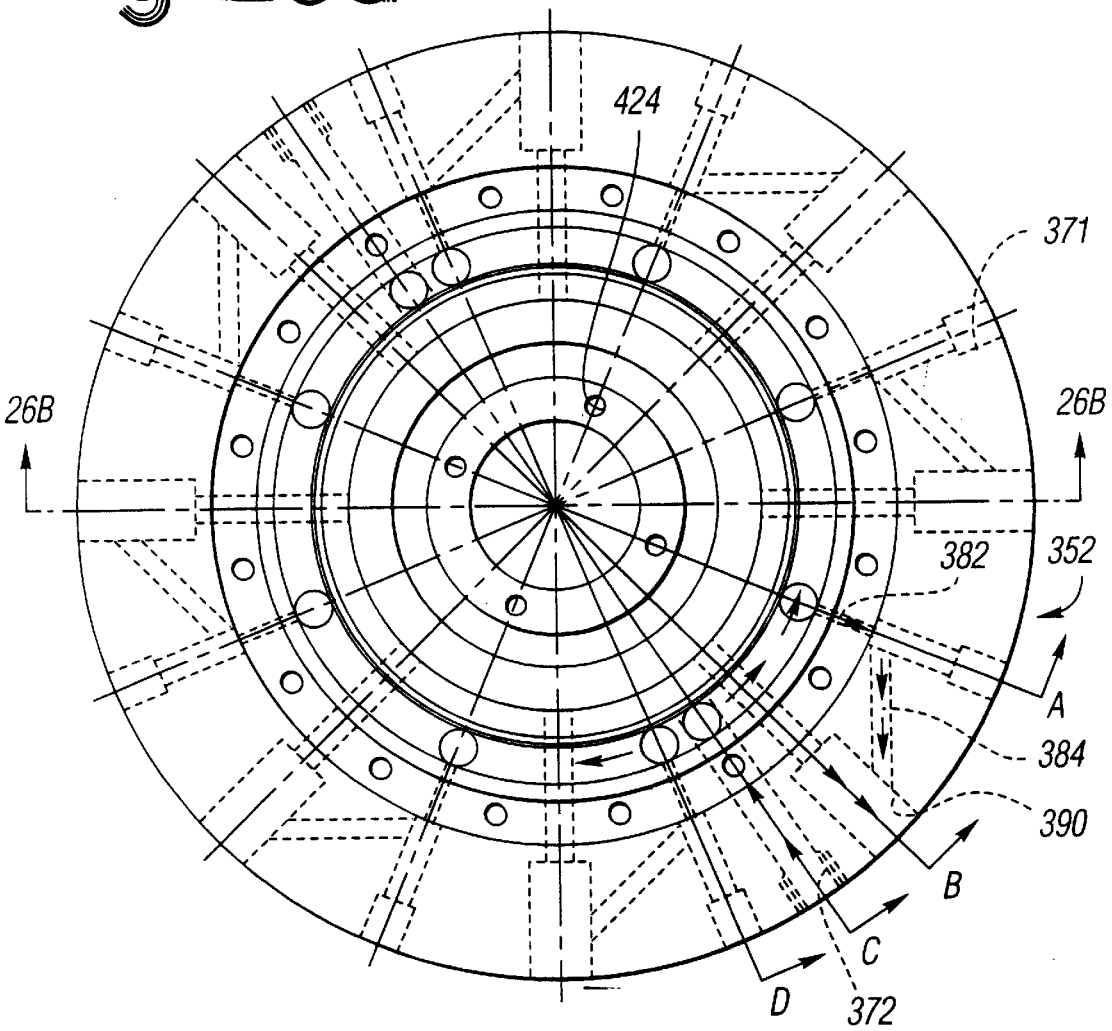
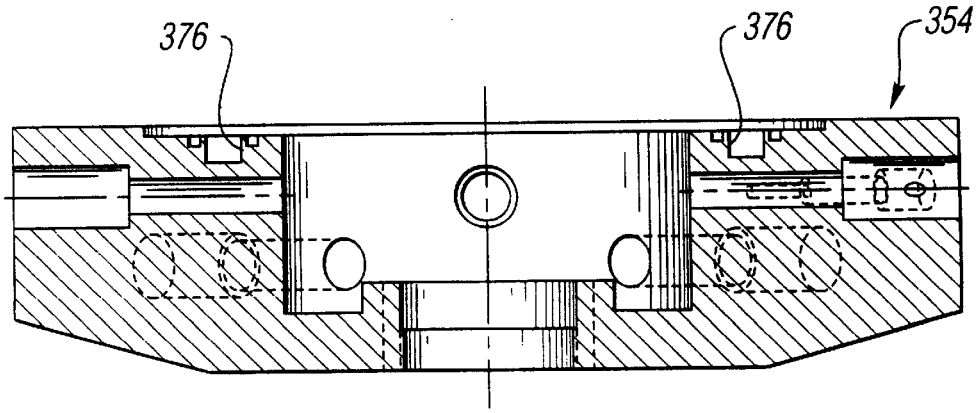
Fig-26b

Fig-38a
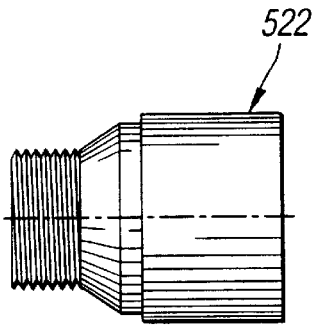
Fig-38c
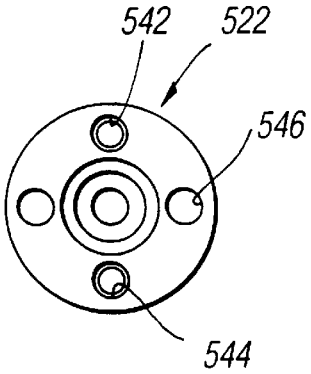
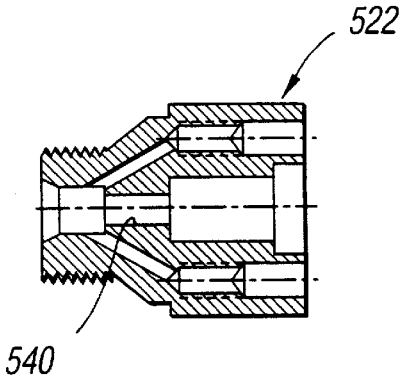
Fig-38b
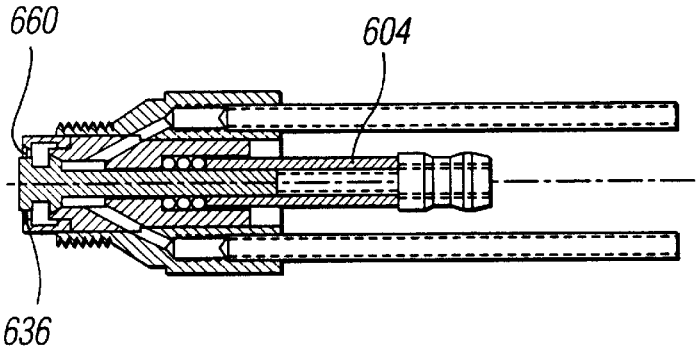
Fig-39a
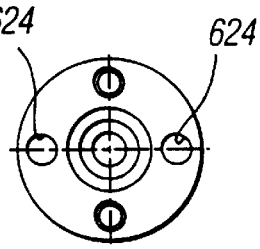
Fig-39b
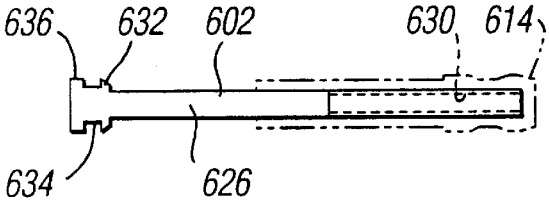
Fig-40a
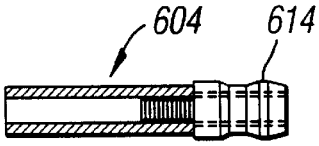
Fig-40b Fig-40c
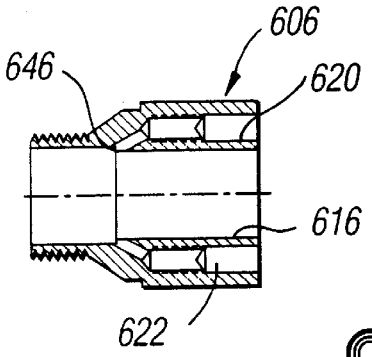
Fig-40e
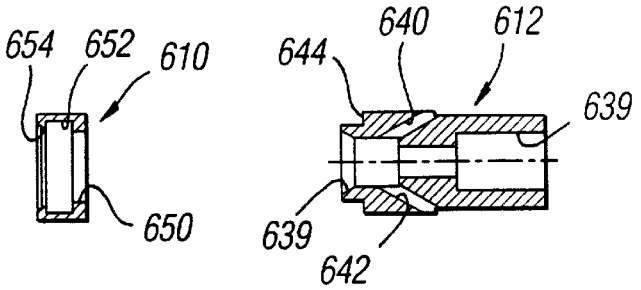
Fig-40d
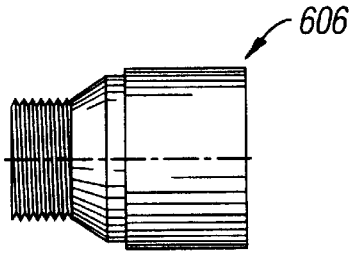
Fig-40f
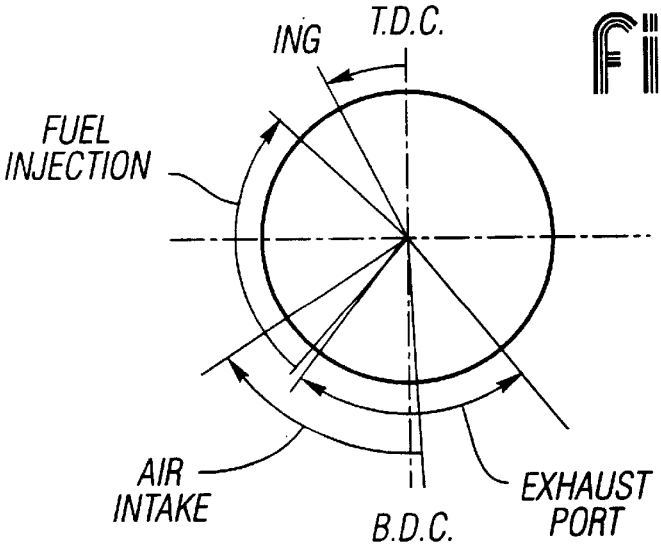
Fig-41

ROTARY FUEL PUMP AND COMBINATION FUEL INJECTOR/SPARK PLUG

CROSS-REFERENCE TO RELATED APPLICATION

This application is a continuation-in-part of U.S. patent application Ser. No. 08/048,821, entitled Internal Combustion Rotary Engine Having A Stacked Arrangement Of Cylinders, filed Apr. 16, 1993, now U.S. Pat. No. 5,315,967.

TECHNICAL FIELD

This invention relates to an internal combustion rotary engine and, in particular, to an internal combustion rotary engine having a stacked arrangement of cylinders in a plane on top of another set of cylinders in a parallel plane and having a rotary cam driven fuel pump and fuel injector.

BACKGROUND OF THE INVENTION

Reciprocating piston engines are well known in the prior art, the most common having a rotating crankshaft with off-set eccentric surfaces to which the pistons are connected for their reciprocation. Usually, there is a piston rod for each piston that connects the piston to the eccentric surface. This arrangement is commonly found in the well known V-8, straight 6 and 4 cylinder engines used in automobiles and boats. There are also the usual camshafts and valves, spark plugs and an ignition system. One of the problems with this arrangement is that the engines mentioned require the size of the engine block to be long enough to handle at least four pistons in a line. Considering that a single piston is about three inches or more in diameter, when multiplied by four and then adding in the cylinder size plus a cooling jacket surrounding each cylinder, the block will measure twenty inches or more. Engines of this size take a lot of space in an engine compartment. Also, the conventional V-8 and straight 6 and 4 cylinder engines have been inefficient for their size and weight.

It is also known that rotary engines use radial placement of the pistons around a crankshaft with eccentric surfaces, require less space, and have fewer moving parts. Commonly, the pistons are connected to the crankshaft by piston rods. This type of engine does not require long crankshafts since there are generally four pistons radiating from the crankshaft and in the same plane. Most rotary engines have four pistons positioned 90 degrees apart, and a few have more. There are a few fluid motors which have two banks of four pistons stacked and connected to the same crankshaft. Two examples of this stacked arrangement are shown in U.S. Pat. Nos. 1,488,528 and 2,709,422. When pistons are arranged in a radial pattern and are 90 degrees apart, the pistons 180 degrees apart are often referred to as opposed pistons.

One of the difficulties with radial or opposed piston engines is providing an intake valve system to supply an air or a fuel/air mixture to the cylinders as needed. The usual intake valve and manifold arrangement with a camshaft to open and close the intake valves does not appear to be the answer, since the valves would have to be mounted on each head along with an overhead cam, adding substantially to the engine size and weight. One valve system of interest is shown in U.S. Pat. No. 3,584,610, where the intake valves extend coaxially through the pistons and includes valve stems carrying slotted guides and tension springs. A lobed cam moves the piston and intake valve against the valve closing force of the spring to open the valve to admit ignition gases to the combustion chamber. A similar type of piston with an intake valve is shown in U.S. Pat. Nos. 1,010,754 and 1,580,720. In the patents cited, the fuel or fuel/air mixture are pumped into the crankcase where the crankshafts and other moving parts are located. Such a crankcase design does not provide proper lubrication of these moving parts, where high revolutions require the shaft bearings and the reciprocating pistons to be well lubricated to reduce wear. To avoid the use of overhead cams, rocker arms, etc., which make up the well known assembly or the intake valve-in piston arrangement with poor crankcase lubrication, a different valve system is needed. The present invention addresses this need.

A problem many fuel pumps on internal combustion engines have is that they do not deliver uniform amounts fuel from each of a plurality pumps to respective combustion chambers of the engine. Accordingly, the engine does not run smoothly as the amount of force produced by each ignition of gases within the plurality of combustion chambers is different.

Another problem internal combustion engines have is that they are overly complex with many parts. For example, with fuel injectors many parts are typically needed such coil springs, seals and spark plug. This invention seeks to reduce the number components required to make a fuel injector.

SUMMARY OF THE INVENTION

The primary object of the invention is to provide an engine that is of light weight, smaller without sacrificing horsepower, and having an improved valve system. This object also takes advantage of a piston arrangement where the pistons are in contact with a rotary crankshaft without being connected to it.

The invention relates to an internal combustion rotary engine, and in particular to an internal combustion rotary engine having a stacked arrangement of cylinders in a plane on top of another set of cylinders in a parallel plane.

Disclosed is an engine block of smaller dimensions than the known blocks with four cylinder blocks and heads spaced about 90 degrees apart around the engine block. The disclosed engine block has a crankcase in which a crankshaft rotates. Lobes of the crankshaft are mounted on the crankshaft parallel to one another to create two eccentrics circumferentially spaced apart to counteract any vibrations that would be present if parallel eccentrics are moving together.

In one embodiment, the engine block is structured to handle two rows of four cylinders with corresponding pistons. The pistons freely reciprocate in their respective cylinders, riding on one of the eccentric lobes in one direction and being subject to fluid pressure in the other. Each piston has a stationary piston rod with an eccentric engaging end that is constantly in contact with the associated lobe.

The cylinder heads house a valve system that does not include tappet valves commonly found in internal combustion engines. The valves include a rotary tube with ports that open once every revolution to supply a fuel/air mixture to each cylinder. Each rotary valve has two sets of ports, one set for a cylinder in one row of cylinders, and the other set of ports for a cylinder in the other row of cylinders. In one embodiment, the two sets of ports are arranged 135 degrees off-set. As one set is supplying a fuel/air mixture, the other set is closed. The pistons and rotary valves are positioned so that as the fuel/air mixture or air is supplied to one piston, the opposed piston is fully extended in its cylinder (FIG. 2). This compresses a fuel/air mixture at the same time as the piston clockwise of the piston supplied with fuel moves inward under the force of ignited fuel. The piston opposed to the inwardly moving piston moves outward in its cylinder, expelling exhausted fuel. Having multiple rows, or banks of cylinders and phasing the engine operation such that when a piston in one row is receiving a fuel supply, the opposed piston in another row is also receiving a fuel supply. These pistons are moved inwardly by the forces of ignition.

In the preferred embodiment, the fuel system includes a fuel injection system which injects pressurized fuel through fuel injectors directly into the cylinders. A ram air blower pressurizes air and directs it to the rotating valves for distribution to the cylinders. The fuel injection pump is connected to a gear system, which rotates the ram air blower to turn a camshaft. Cam followers pivoted by the cams actuate spring tensioned plungers which force fuel through injection lines to the fuel injectors.

A rotary fuel pump for pumping fuel is disclosed. The pump comprises a rotatable camshaft having an eccentric cam thereon, a first rocker arm pivotal mounted relative to and following the eccentric cam, a cylinder having a fuel access bore therein for receiving fuel and having a plunger bore and a plunger actuated by the rocker to reciprocate within the plunger bore. When the camshaft is rotated, the first rocker arm pivots causing the plunger to reciprocate pumping fuel from the plunger bore.

Preferable, the pump also has a second rocker arm pivotally mounted relative to the eccentric cam and located intermediate the first rocker arm and the plunger such that eccentric cam drives the first rocker arm which drives the second rocker arm which drives the plunger. Ideally, each of the first and second rocker arms have pivot pins, and the pivot pins can be translated relative to one another to vary the length of stroke of the plunger and the amount of fuel pumped per stroke of the plunger. The pivot pin of the second plunger arm is preferably pivotally mounted on a rotatable plate, the rotatable plate being rotatable about the axis of the camshaft to move the pivot pins relative to one another.

A fuel injector for receiving and injecting fuel into the combustion chamber of an internal combustion engine is also taught. The fuel injector comprises a housing, a plunger, and a spring. The housing has a plunger bore and an inlet bore in fluid communication with the plunger bore. Also, the housing has a valve seat. The plunger reciprocates within the plunger bore and has also has a valve seat. The spring biases the valve seat of the plunger against the valve seat of the housing. When the inlet bore of the housing receives fuel of sufficient pressure, the pressurized fluid presses upon the plunger to overcome the biasing of the bias means with the valve seats separating allowing the pressurized fuel to escape therebetween from the plunger bore. Preferably, the spring includes at least one elastomeric O-ring interposed between the plunger and the housing.

A combination spark plug and fuel injector for receiving fuel and current and injecting an igniting spark and fuel into a combustion chamber is also provided. The fuel injector comprising a housing, a plunger, an insulator and a valve. The housing has a plunger bore and a fuel inlet bore. The plunger locates within the plunger bore of the housing. Interposed between the housing and the plunger is the insulator to prevent electrical current from passing therebetween, the housing and the plunger forming a spark gap. The valve controls the injection of fuel from the plunger bore. Fuel can pass through the valve to be injected into a combustion chamber and wherein sufficient current is received by the plunger, an electrical short will occur across the spark gap producing a spark.

It is an object to provide a fuel pump wherein a plurality of plungers pumping fuel are actuated by a single rotary cam whereby uniform amounts of fuel are pumped by each of the plungers.

Another object is to provide a rotary fuel pump having a rotary cam driving cooperating inner and outer rocker arms to actuate a plunger pump, whereby moving the inner and outer rockers relative to one another, the output of fuel per stroke of the plunger can be varied.

Still yet another object is to provide a fuel injector utilizing elastomeric O-rings to control the pressure needed to operate the fuel injector.

A further object is to provide a fuel injector which also serves as a spark plug providing both fuel and spark to a combustion chamber of an internal combustion engine.

BRIEF DESCRIPTION OF THE DRAWINGS

FIG. 16 is a section view taken along the line 16—16 of FIG. 15;

FIG. 17 is a perspective view of a ram air cowling with a metering air system;

FIG. 18 is a exploded partial side view of the rotary engine with a ram air cowling and metering air system;

FIG. 19 is a fragmentary cross-sectional view of the metering air system shown assembled;

FIG. 20 is a top view of a valve seat of the invention; and

FIG. 21 is a side elevational view of a valve seat of FIG. 20.

FIG. 22 is a top plan view, partially in cutaway, of a second embodiment of the rotary engine;

FIG. 23 is a side view, partially in cutaway, of the rotary engine of FIG. 22;

FIGS. 26A–D include a top and sectional views of a pump housing of the rotary fuel pump;

FIGS. 38A–C are side, sectional and end views of the fuel injector;

FIGS, 39A–B are sectional and end views of an alternative fuel injector;

FIGS. 40A–F are components comprising the alternative fuel injector; and

FIG. 41 is a valve timing schematic of a piston.

DESCRIPTION OF THE INVENTION

Figure 1:
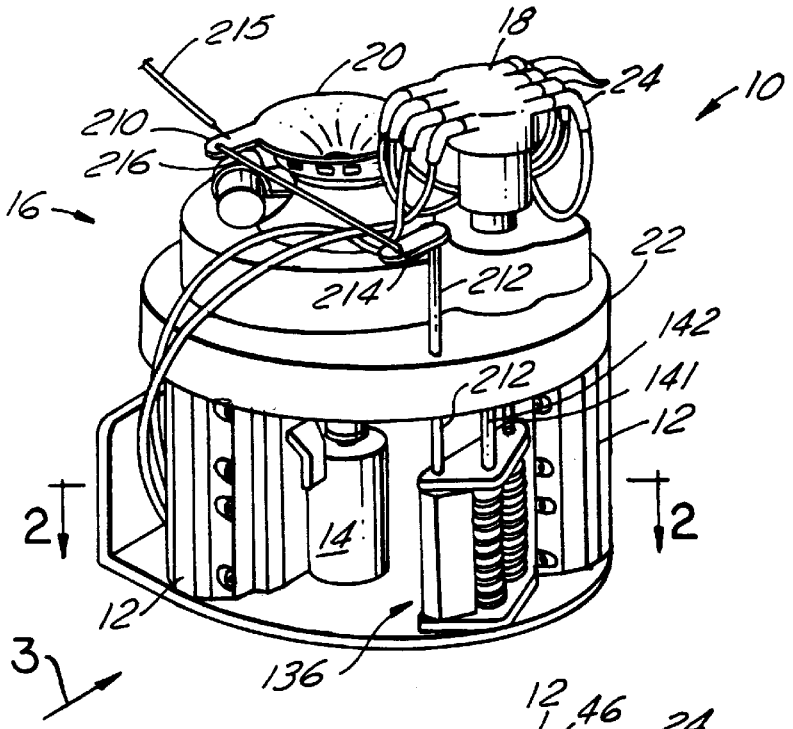
FIG. 1 is a perspective view of a rotary engine of the invention.
Figure 2:
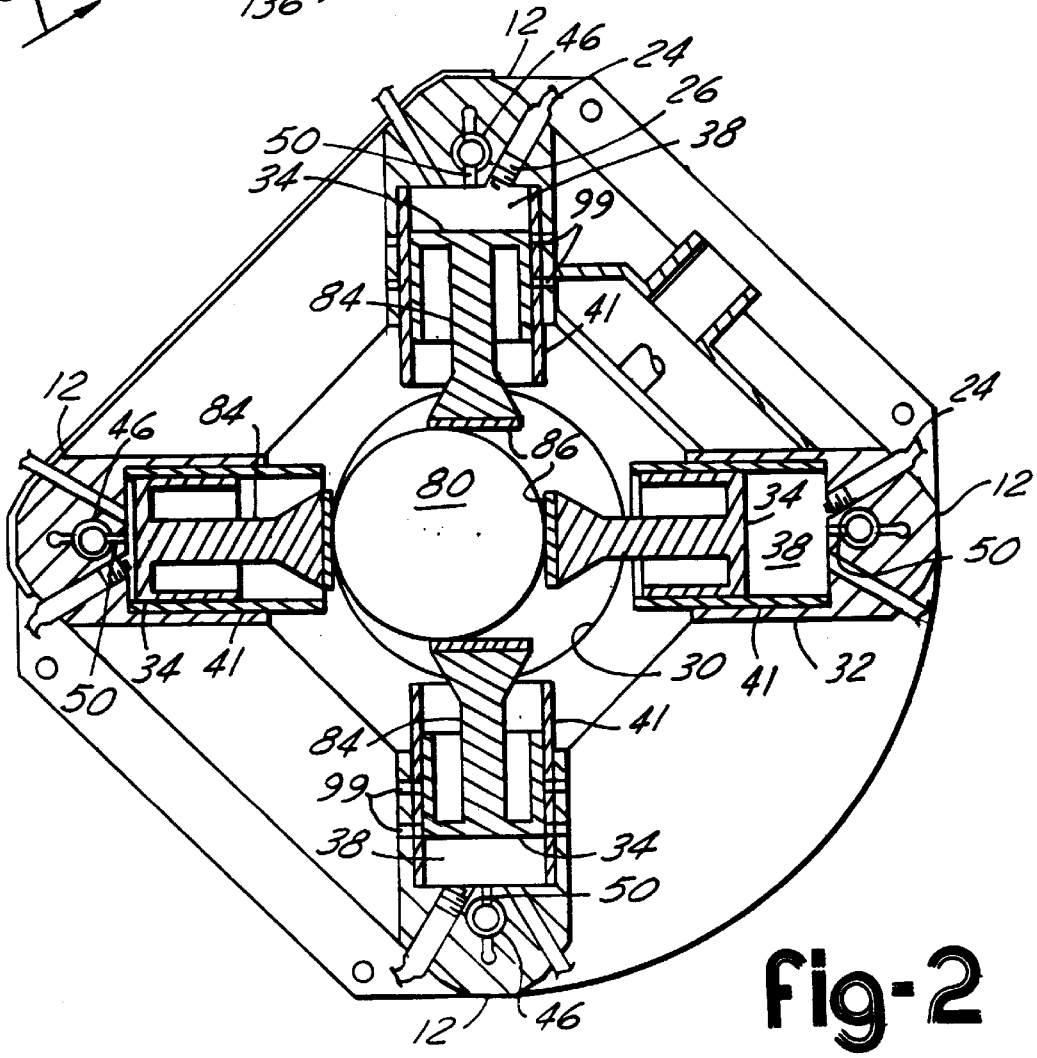
FIG. 2 is a cross-sectional view taken along the line 2—2 of FIG. 2.

Referring to FIGS. 1–16, there is shown a rotary engine 10 according to the present invention. The embodiment depicted in FIG. 1 discloses a rotary engine 10 with two of its four cylinder heads 12 showing, a starter 14, and a top end assembly 16. The top end assembly 16 includes a distributor 18, and a carburetor 20 mounted on a ram air cowling 22. Distributor 18 includes the usual electronic ignition well known in the automotive art, and ignition wires 24 connected to spark plugs 26 (FIG. 2). Air metering system 20 will be fully described below in the discussion of FIGS. 17–19.

Rotary engine 10 has an engine block with a center bore 30 (FIG. 2). There are cylinders 32 in the block radiating from bore 30. In the embodiment depicted, such cylinders are approximately 90 degrees apart, but the invention is not so limited. Each cylinder 32 houses a piston 34 which reciprocates. Four cylinder heads 12 occlude the cylinder combustion chambers 38. Cylinder head 12 covers a pair of cylinders in adjacent rows, or banks, shown best in FIG. 3. Between the cylinder heads 12 and the engine block is an exhaust port block 36 (FIG. 10) which has cylinder bores 40 that form part of the cylinder head 12. A pair of exhaust ports 45 extend from cylinder bore 40 to outside surface 43 of the exhaust port block 36. Each cylinder head 12 has a cylinder sleeve 41 to provide a close fitting surface for each associated piston 34. The sleeves 41 are removable when a loose or seized fitting relationship between a cylinder and piston exists.

Figure 9:
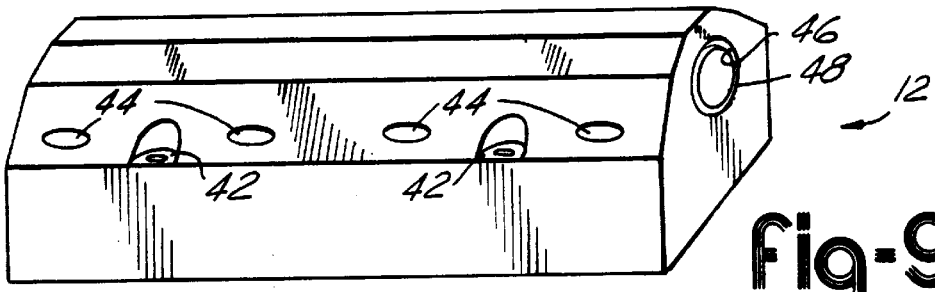
FIG. 9 is a perspective view of a cylinder head of the invention.
Figure 10:
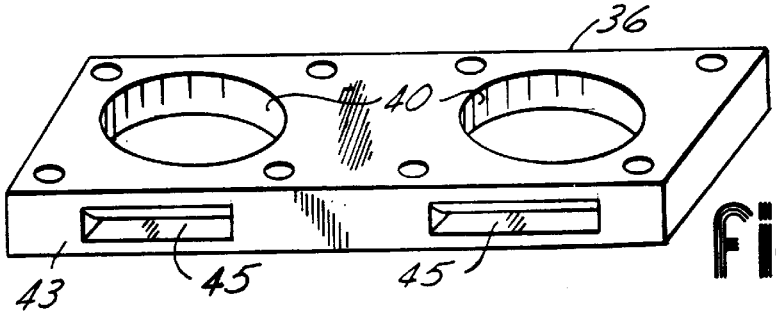
FIG. 10 is a perspective view of an exhaust block of the invention.

A cylinder head 12 as shown in FIGS. 2 and 9 has spark plug ports 42 and bolt holes 44. A longitudinal bore 46 extends through the cylinder head 12. Bore 46 has a sleeve 48, preferably of bronze, pressed into it and forms a bearing surface. A pair of slots 50 extend through sleeve 48 and from longitudinal bore 46 to combustion chamber 38. Fitted in longitudinal bore 46 is a rotary valve 52, best shown in FIGS. 4 and 6. The rotary valve 52 is a cylindrical tube with a closed end 53 and an open end 55 and having, in the preferred embodiment, a first set of ports 54 and a second set of ports 56. Each of the cylinder heads 12 covers a cylinder pair where one of the cylinders is one of a bank of, for example, four cylinders in a single plane radiating from crankcase bore 30. The other cylinder pair is one of the second banks of, for example, four cylinders in another parallel plane. One set of ports 54 is in contact with the combustion chamber of a cylinder in one bank and another set of ports 56 is in contact with the combustion chamber of a cylinder in the other bank. Therefore, as the rotary valve 52 rotates in sleeve 48, one set of ports 54 opens to align with one of the slots 50 to admit a fuel and air mixture at the same time the other set of ports 56 is closed. The ports 54 are 180 degrees out of phase with ports 56 when there are two banks.

Figure 14:
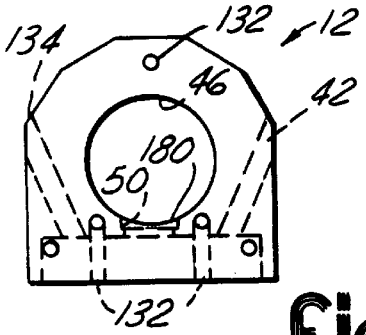
FIG. 14 is an end view of another embodiment of a cylinder head of the invention.

In FIGS. 20 and 21, a different type of bearing plate 180 for the rotary valves 52 is shown. In place of the sleeve 48, the bearing plate 180 is pressed into cylinder head 12 and, in particular, slots 50. FIG. 14 shows bearing plate 180 pressed into slots 50 through longitudinal bore 46. Plate 180 has an arcuate bearing surface 182 (FIG. 21), which conforms to the diameter of bore 46 and to the exterior diameter of rotary valve 52. There are two ports 184 which extend through the plate 180 to connect valve 52 with the combustion chamber 38 of cylinders 32. Bearing plate 180 has an undercut 186 around the exterior periphery 181 to provide a ridge 188 that seats in a groove (not shown) in cylinder heads 12.

Figure 4:
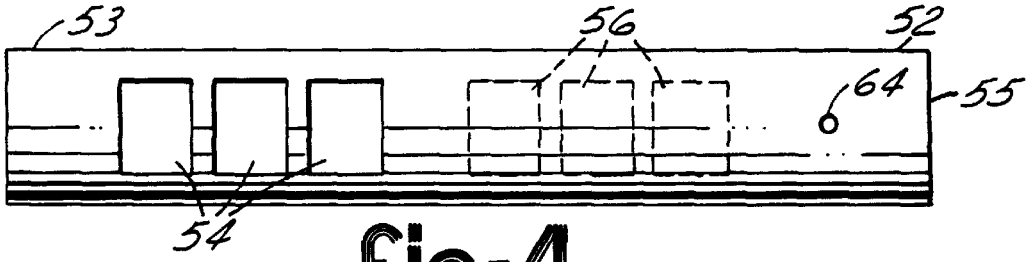
FIG. 4 is a front view of a valve of the invention.
Figure 5:
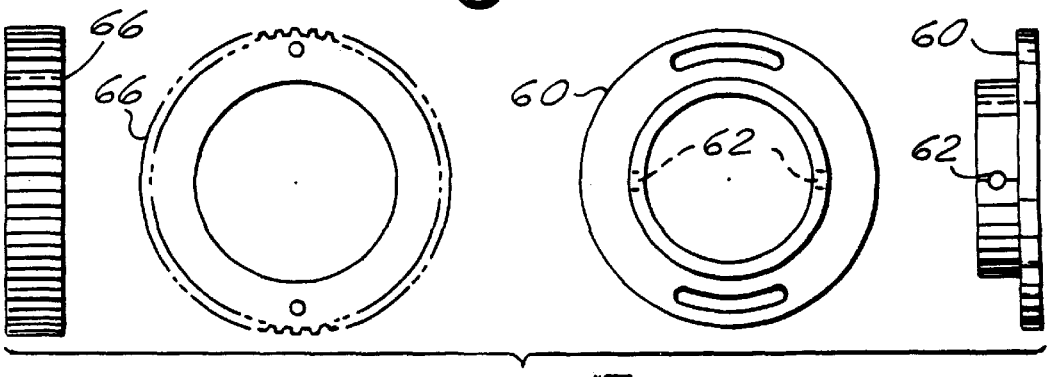
FIG. 5 is a exploded view of a valve gear of the invention.
Figure 6:
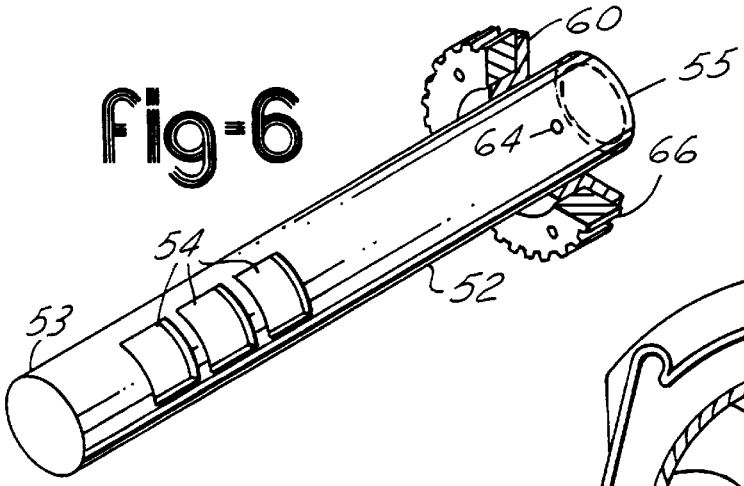
FIG. 6 is a perspective view of the valve.

The open end 55 of the rotary valve 52 has a gear assembly 58 mounted on it (FIGS. 5–6). There is a ring 60 with set screw holes 62 to align with similar set screw holes 64 on the rotary valve. A set screw, not shown, fastens ring 60 to the rotary valve 52 via holes 62 and 64 (FIG. 4). A ring gear 66 attaches to ring 60 and extends beyond cylinder head 12 where a gear system 68 (FIG. 8) rotates gear 66 and, consequently rotary valve 52.

Gear system 68 has a drive gear 70 and four intermediate gears 72 which connect ring gears 66 to drive gear 70. Drive gear 70 is attached to a crankshaft 74 for rotation. A distributor gear 76 is driven by drive gear 70 to rotate the distributor rotor. The engine starter 14 connects to the gear system 68 via gear 78 to turn the entire gear system and crankshaft 74 to start the engine 10. The starter 14 has an override to disengage the starter once the engine is running.

Figure 3:
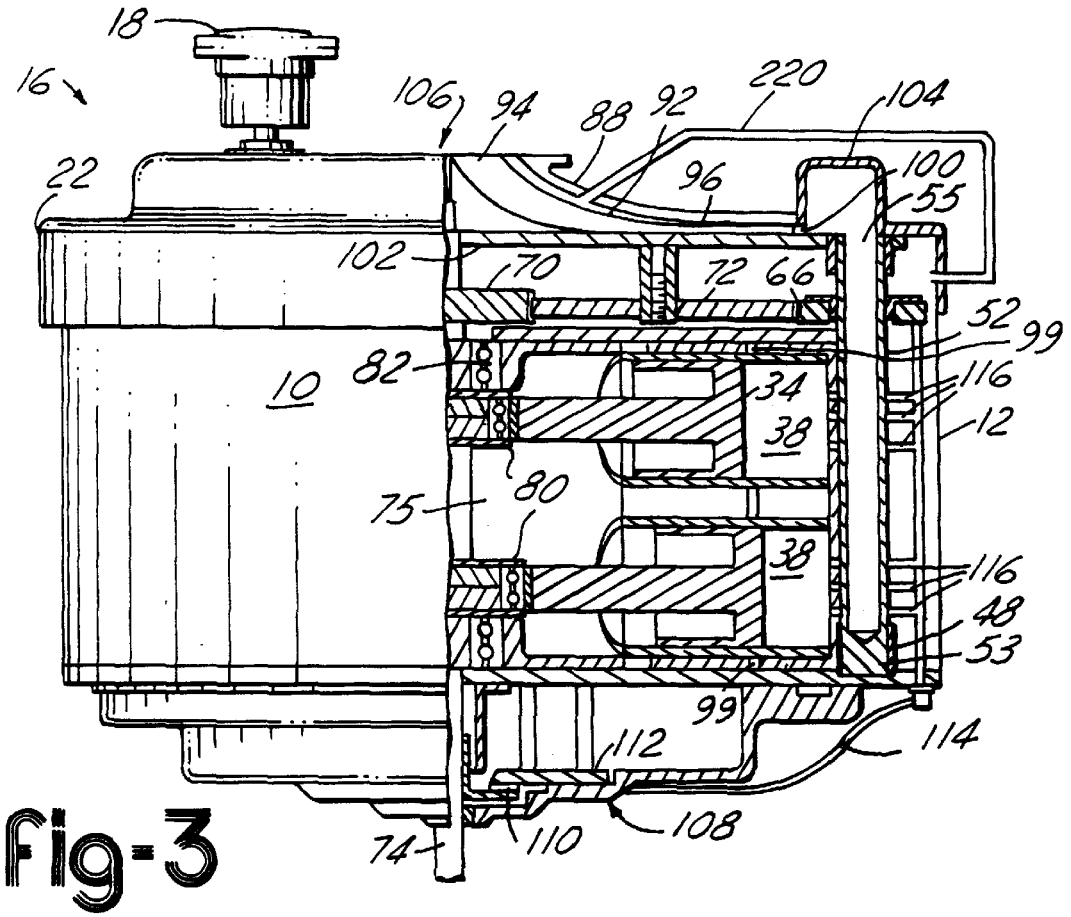
FIG. 3 is a partial view in the direction of arrow 3 with parts broken away of FIG. 1.

Crankshaft 74 is shown in FIG. 3 with a pair of eccentric cams 80. One end of the shaft 74 is connected to the gear system 68, and the other end is the output end which connects to a transmission. The crankshaft 74 is supported on main bearings 82 in crankcase 30. Pistons 34 have stationary piston rods 84 with enlarged lands 86 that ride on the surfaces of the eccentric cams 80. As the crankshaft 74 rotates, one of the eccentric cams 80 controls the outward movement of the pistons 34. Inward movement of each piston is controlled by pressure generated by a ram air blower 88, which will be explained. The combustion chamber 38 of each piston and cylinder sets is either in a state of being charged with a high pressure fuel/air mixture, further compressing the mixture, expansion of the ignited mixture, or exhausting the spent mixture. In the situations where the combustion chamber is charged and the mixture is ignited, there is a force on the piston face which presses the land 86 against the eccentric cam 80. In the other situations where the mixture is compressed or exhausted, the eccentric cam 80 forces the piston outward to compress the mixture, or to expel the exhaust mixture through exhaust valves 99 in the cylinder sleeve 32. The opening and closing of the exhaust valves is not shown. In FIG. 2, an exhaust manifold is shown to remove exhaust.

The carburetor 20 serves as an air metering system 21 as best shown in FIGS. 7 and 17–19. To supply air for the engine, air is drawn into the engine through the air metering system 21 by the ram air blower 88. Mounted on the ram air cowling 22, the air metering system 21 includes a collar 190 that is formed with cowling 22. Collar 190 is tapered with a center opening throat 192 extending into the engine. The larger end 194 of collar 190 has a rim for supporting a rotatable plastic collar 196. The exterior of collar 196 is similar to the interior of collar 190, so that as collar 196 rotates it is in close contact with the interior of collar 190, shown best in FIG. 19. Each of the collars 190 and 196, respectively, has ports 198 which cooperate to open and close to form a valve to admit and stop the flow of air. Collar 196 is tapered and is open at its top and bottom.

Covering collar 196 is a frustoconical cone-shaped cover 200. There is a cone-shaped wall 202 with an arcuate curve which is designed to direct the air drawn into the air metering system into the ram air blower 88. Air is drawn through the ports 198 of collars 190 and 196 where it impinges against the arcuate curve of wall 202, to be directed to throat 192. Cover 200 can be bonded to the rim 204 of collar 196 to form a seal between the edges of the cover and collar, as shown in FIG. 19, where arrows show the air flow. To protect the internal moving parts of the opening from moisture, dirt and dust, an air filter, not shown, is wrapped around the exterior of collar 190. There may also be an air filter canister housing the air filter.

To rotate collar 196, there is a lever 210 (FIG. 17) connected to rim 204 and a pivotal rod 212 extending from ram air cowling 22. A second lever 214 is mounted on rod 212 and connected to lever 210 by a link 215. A throttle cable 216 connected to lever 210 moves collar 196 to open and close ports 198, thereby adjusting the amount of air drawn into the engine. Pivotal rod 212 extends through ram air cowling 22 and is attached to the fuel inlet of a fuel injection pump 136 to adjust the fuel flow to pump 136, thereby providing a proper air-fuel mixture in the cylinders.

Figure 7:
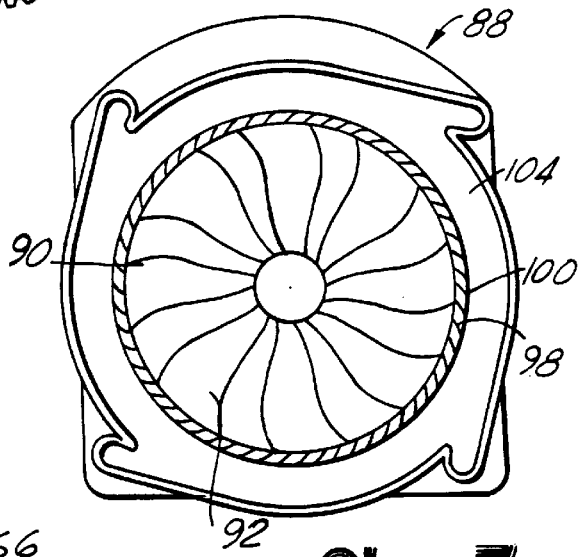
FIG. 7 is a bottom view of a ram air blower of the invention.
Figure 8:
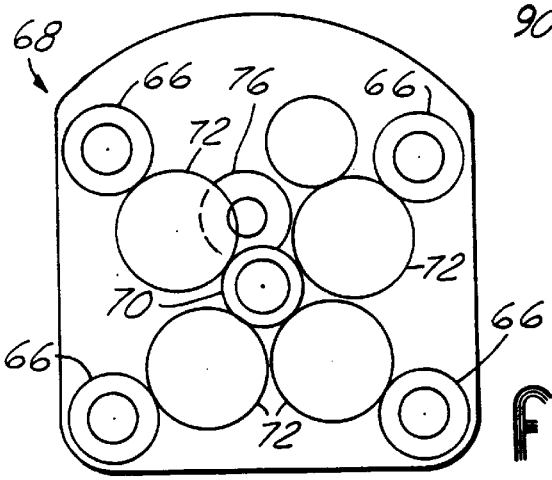
FIG. 8 is a schematic of a gear system of the invention.

Turning to the ram air blower 88, in FIGS. 3 and 7 there is a driven vane propeller 90 with arcuately-shaped air capturing and pressuring vanes 92. A side view of vane 92 shows a large air capturing face 94 and a small pressurizing face 96. The vane 92 tapers from capturing face 94 to the pressurizing face 96. Therefore, as the captured air is forced along the vane 92, it is compressed until it reaches the end of the pressurizing face 96, where it is pushed through a circular stationary vane 98 having angled vanes 100 (FIG. 7). The blower 88 is enclosed in a ram air cowling 22, which is contoured to cooperate with vanes 92 and an end plate 102 to aid in pressurizing the air. Beyond the blower 88, the cowling 22 has a small expansion chamber 104 leading to a rotary valve 52 and the open end 55. A carburetor 20 (not shown) is mounted on an inlet opening 106 of the ram air blower 88. A fuel pump, not shown, delivers fuel to the carburetor 20 where the fuel mixes with air and is then introduced to the ram air blower.

FIG. 3 shows the output shaft 74 and an oil pump assembly 108. Rotary engine 10 is suited for operation with the output shaft 74 in a vertical position which allows gravity return of lubricating oil to the oil pump assembly 108. There are pump impellers 110 mounted on the shaft 74 which cooperates with an impeller plate 112 to force lubricating points 116 to provide lubricant to the moving parts.

In use, a fuel and air mixture is supplied to the cylinder combustion chambers during their charging stroke, which is timed to the opening of the rotary valves 52. The starter 14 begins reciprocating the crankshaft 74, pistons 34, gear system 68 and rotary valves 52. Distributor-controlled spark plug firing ignites the compressed fuel/air mixture that has been compressed in the proper combustion chamber to force the piston 34 against the eccentric cam 80 to continue the rotation of the crankshaft 74 and reciprocation of the pistons 34. Pressurized fuel/air mixture delivered from the ram-air blower 88 to the combustion chambers 38 applies a force to the face of the pistons to reciprocate the pistons inward, and maintain contact of the piston lands 86 with eccentric cams 80. The opening and closing of the intake valves 52 and exhaust valves 99 are timed to synchronize with reciprocation of the pistons. To draw a vacuum in crankcase 75, a vacuum line 220 is connected between ram air blower 88 and the crankcase.

Figure 11:
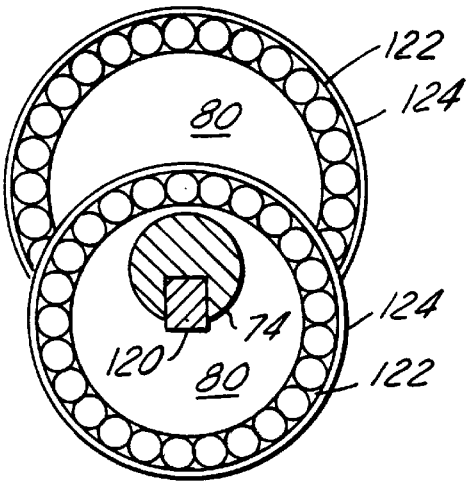
FIG. 11 is an end view of a crankshaft of the invention.
Figure 12:
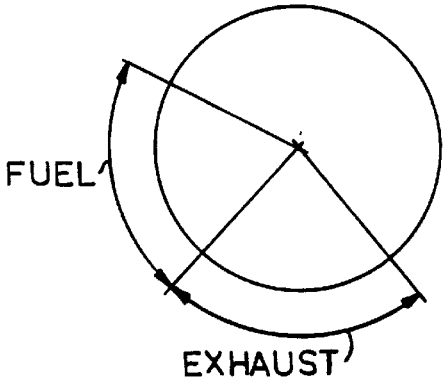
FIG. 12 is a schematic of the valve opening and the exhaust valve opening.

In the preferred embodiment, rotary engine 10 is equipped with two rows, or banks, of four rotary pistons. Therefore, there are two eccentric cams 80 keyed to crankshaft 74 by key 120 (FIG. 11). Each eccentric cam 80 has a bearing race 122 with a bearing ring 124 for contacting the associated piston land 86. The opening and closing of the intake valves 52 and exhaust valves 99 are timed so that the intake valves in one bank are open in a combustion chamber. Simultaneously, the exhaust valves are closed to the same chamber and the intake valves in the other bank, controlled by the same rotary valve 52, are closed to the adjacent combustion chamber, and the exhaust valves are open, as represented in FIG. 12.

A fuel injection system 136 is used to feed pressurized fuel to each cylinder (FIG. 14). Cylinder head 12 has a longitudinal bore 46 and a pair of slots 50, one shown, for sending pressurized air to the cylinder combustion chamber. There is a spark plug port 42 and oil ports 132 which connect to the oil lubricant line 114 (shown in FIG. 3). Oil ports 132 extend through the head 12 to connect to oil ports in the engine block to lubricate the pistons 34 and other moving parts. Cylinder head 12 has fuel injector ports 134 which open into the cylinder combustion chamber 38.

Figure 13:
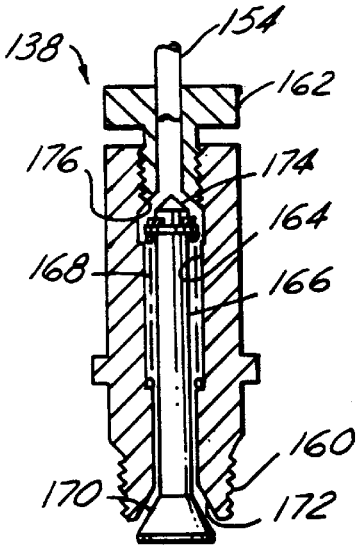
FIG. 13 is a cross-sectional view of a fuel injector of the invention.
Figure 15:
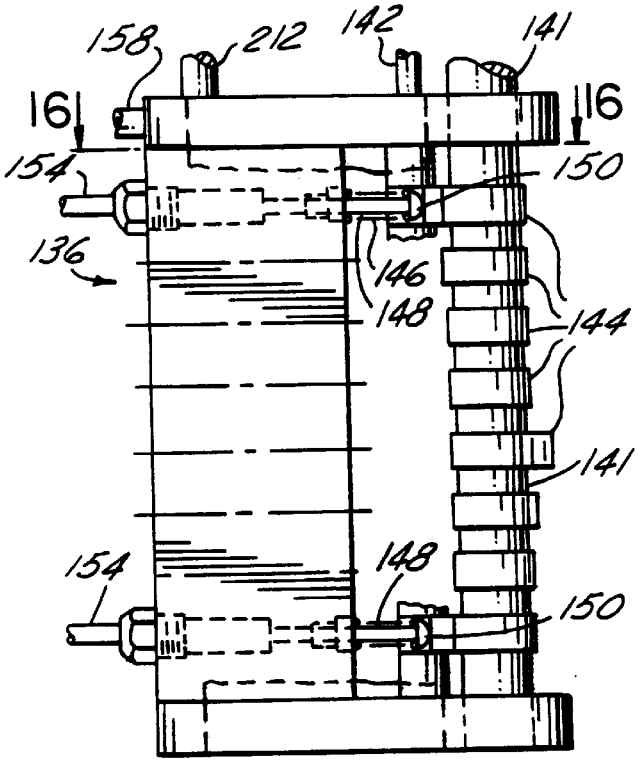
FIG. 15 is a side view of an injector pump of the invention.

The fuel injection system 136 includes an injection rail 152 and fuel injectors 138 (FIG. 13). Fuel injection rail 136 includes a rotating camshaft 141 which connects to gear system 68 of FIG. 8. The fuel injection rail 152 has a plurality of rocker arms 140, two shown, which is pivotable on a pivot rod 142. Rocker arm 140 is pressed against cam lobe 144 by spring tension from spring 146. A push rod 148 with a follower 150 is pressed against the rocker arm 140 by spring 146 so that any pivoting of rocker arm 140 is transmitted to push rod 148, which reciprocates in and out of fuel rail 152. There is a plunger end 156, integral with push rod 148 in communication with an injection line 154 to force fuel under pressure through the line. In one embodiment, there are eight such injection lines 154, running from rail 152 to fuel injectors 138 mounted in cylinder heads 12. Rail 152 has a fuel connection port 158, to which a fuel line from a fuel pump, not shown, and a fuel supply, also not shown, are connected. Fuel port 158 is connected to fuel circulating lines in rail 152 to connect all of injection lines 154 to the fuel supply.

Fuel injector 138 has a threaded end 160 and a screw in connector 162 which connects fuel line 154 to the injector. There is a bore 164 extending through the injector 138 to supply fuel to the combustion chamber. A spring-biased plunger 166 is mounted in bore 164 to shut off the fuel supply when the pressure is below a predetermined level. Spring 168 controls the opening and closing of plunger 166. Plunger 166 has a flared end 170 which mates with a frustoconical tapered bevel 172 in threaded end 160. The top end 174 of plunger 166 has a conical shape to mate with a beveled surface 176 in screw-in connector 162.

Fuel from injector rail 152 is under pressure as it enters the fuel injector 138 to open a space between the mated top end 176 and the plunger top end 174. Also, fluid pressure opens a space between plunger flared end 170 and tapered bevel 172 in threaded end 160 against the force of spring 168.

Using a fuel injection to replace a carburetor also means that only air is pressurized by ram air blower 88 and rotary valves 52 are used to add air to the combustion chambers 38. The fuel is atomized when it enters the combustion chambers to commingle with the pressurized air, thus making ignition by electric spark more explosive. The pressurized air is used to apply force to the face of the pistons to keep them in contact with crankshaft lobes 80.

A second embodiment of a rotary engine 300 is shown in FIGS. 22 and 23. Rotary engine 300 includes rotary cam driven fuel injection pumps 302 connected by fuel lines 304 to fuel injectors 500 for providing fuel to respective combustion chambers 310. In the preferred embodiment, a rotary fuel pump 308 comprises eight fuel injection pumps 302 driven by a single rotary cam 402.

Supercharged air is provided to combustion chambers 310 as described previously in the first embodiment. An air metering system 312 including an induction blower 314 drives air through rotary valves 316 to reach combustion chambers 310. Again, the timing of air metering system 312 and rotary valves 316 are controlled by a gear system, as described above.

Also shown in FIGS. 22 and 23 are a starter motor 320, an ignition coil pack 322, an oil pump 324, and an ignition distributor 326. Further, a planetary gear 330, a spark plug 332, a piston 334 reciprocating within a cylinder 336 having an exhaust port 340, and a crank shaft roller 342 are shown.

Figure 24:
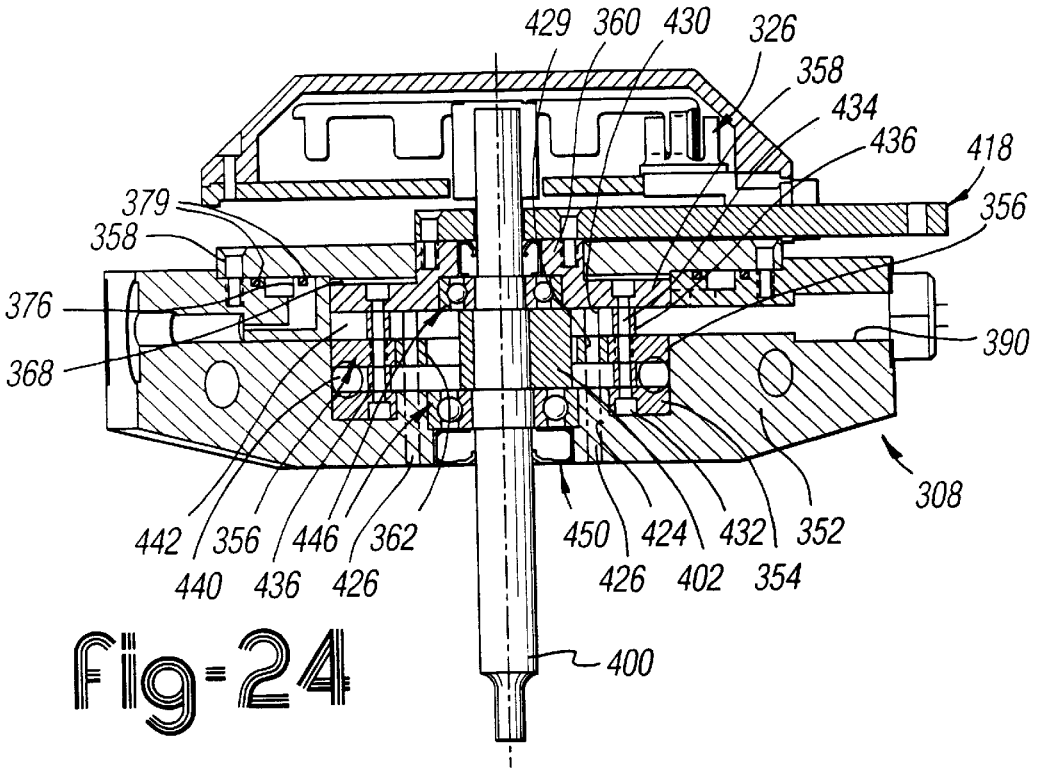
FIG. 24 is a side sectional view of a rotary fuel pump.
Figure 25:
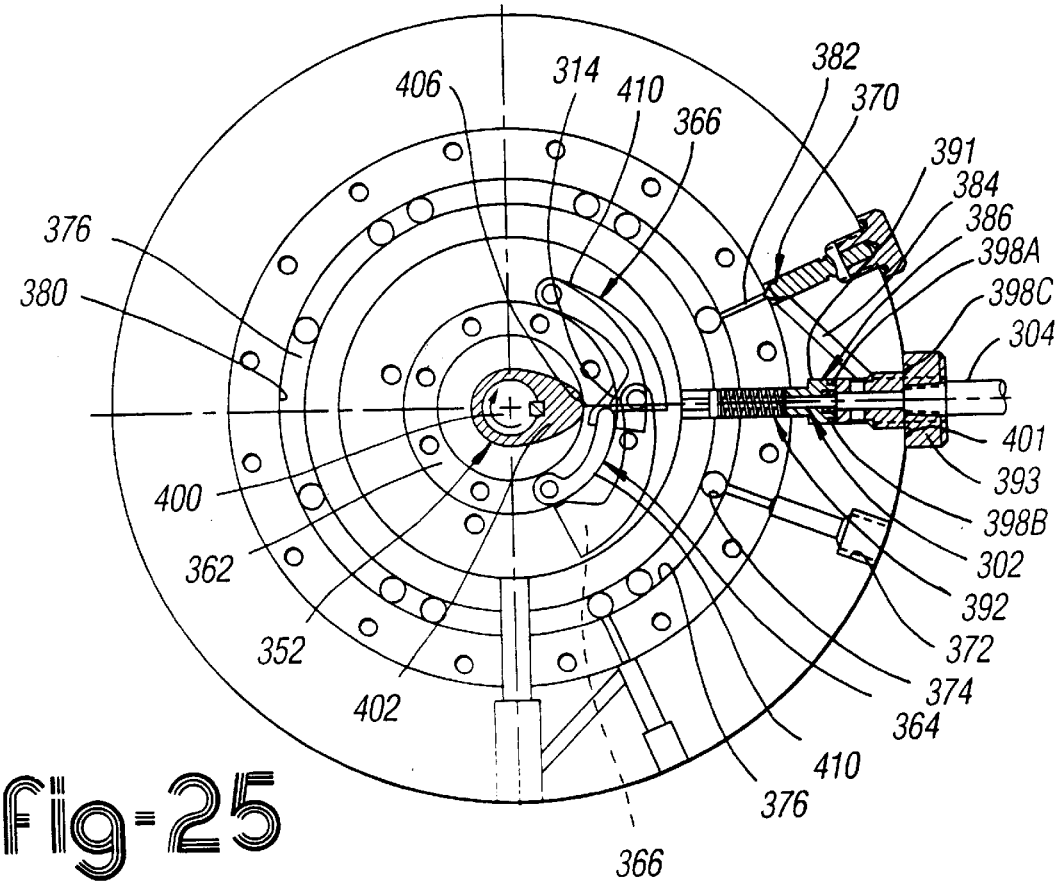
FIG. 25 is a top view of the rotary fuel pump with a cover removed and partially in cutaway.

FIGS. 24 and 25 illustrate the rotary fuel pump 308 in greater detail. Components include pump housing 352, axially spaced bottom, center and top cam plates 354, 356 and 360, inner rocker ring 362, inner and outer rocker arms 364 and 366, a cover plate 358, fuel injection pumps 302 and one-way check valves 370. Pump housing 352 and cover plate 358 cooperate to define a central chamber 368 in which the rocker arms 364 and 366 and cam plates 354, 356 and 360 are located. Pump housing 352 is shown in FIGS. 26A–D and the other components are generally shown in FIGS. 27–35.

Figure 26C:
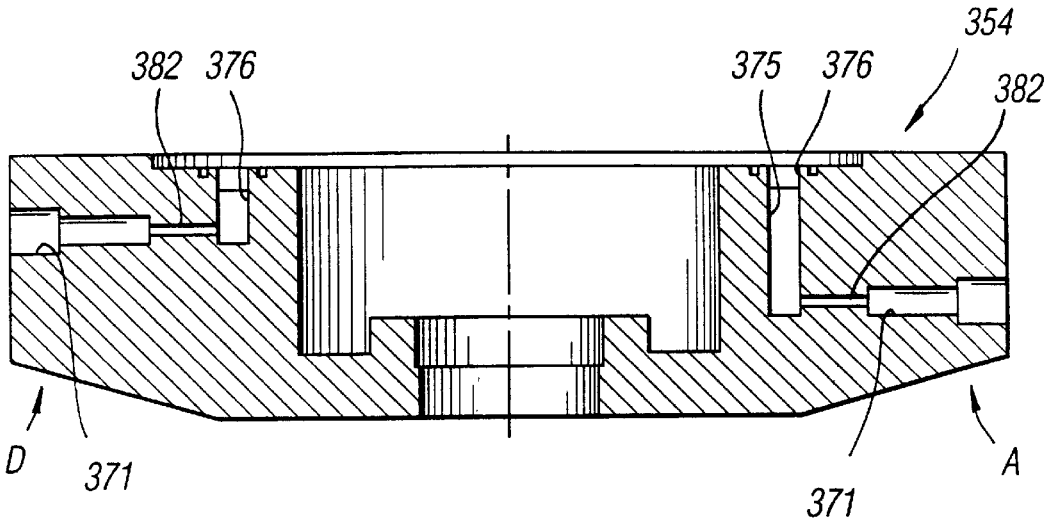
Figure 26D:
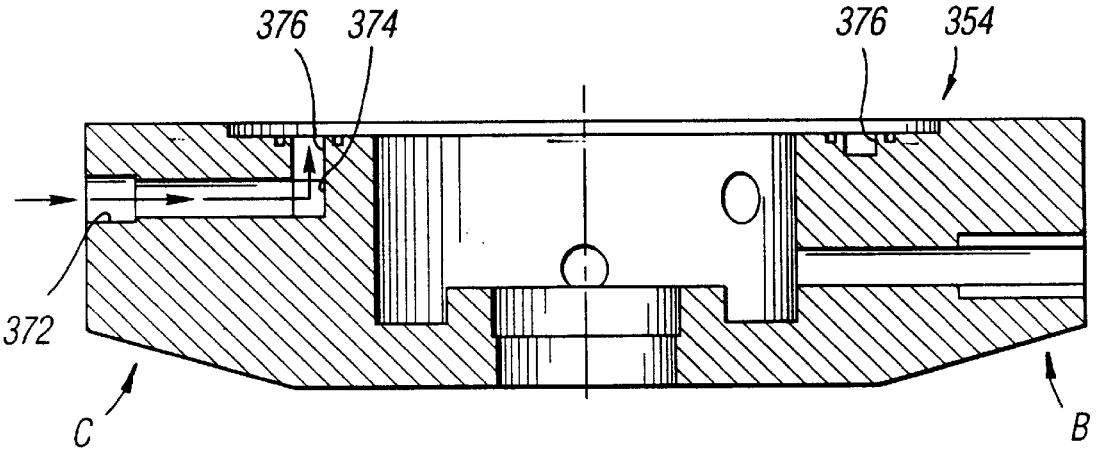

The flow of fuel through pump housing 352 occurs as follows. In FIGS. 26A–D, fuel inlet passageway 372 receives pressurized fuel from an external pump and storage tank (not shown). Preferably, fuel is input at between 40 and 80 psi, and most preferably between 50 and 60 psi. Fuel travels radially inwardly along fuel inlet passageway 372 until reaching vertical fuel passageway 374. Fuel then travels upwardly to annular fuel conduit 376. This upper annular fuel conduit 376 provides fuel via check valve passageways 382 to the check valves 370 located on an upper tier of four check valves 370. An upper check valve bore 371 is shown in sectional view D of FIG. 26C. Section A of FIG. 26C shows one of four downwardly extending passageways 375 which provide fuel through lower check valve passageway 382 to a lower tier of check valves 370. Fuel injection pumps 302 are in fluid communication with transverse conduits 384 to receive fuel from check valves 370. Referring back to FIG. 24, cover plate 358 mounts atop pump housing 352 to define annular fuel conduit 376. A pair of O-rings 379 forms a seal between these members.

Each fuel injection pump 302 includes a plunger 386 (see FIGS. 33A–B) slidably mounted within a pump bore 390 of pump housing 352. Plunger 386 includes a reduced diameter stem 387, an intermediate collar 388, and an enlarged diameter end portion 389. End portion 389 extends radially inwardly to ride upon an outer rocker arm 366. Spring 392, as seen in FIG. 25, surrounds stem 394 of plunger 386 with one end abutting collar 388 and the other end engaging a plunger seal 391 which is held in place by a retaining nut 393. Accordingly, plunger 386 is biased radially inwardly.

Figure 34:
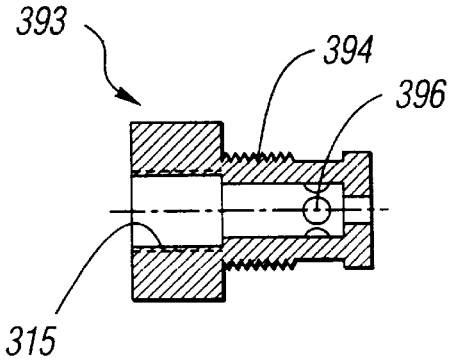
FIG. 34 s a sectional view of a retaining nut.
Figure 35:
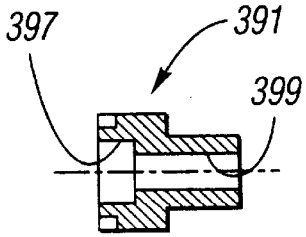
FIG. 35 is a sectional view of a plunger seal.

Plunger seal 391 and retaining nut 393 are seen in FIGS. 34 and 35. Nut 393 has an external thread 394 threadedly fastening to pump bore 390 and an internal thread 395 to assist in connecting a coupling to fuel line 304. Six circumferentially spaced lateral access bores 396 allow fuel from check valve 370 to reach fuel line 304. Plunger seal 391 has an enlarged bore 397 receiving an O-ring 398A for sealing about the stem 387 of plunger 386 and a smaller piston bore 399 in which plunger 386 slides. Preferably plunger seal 391 and retaining nut 393 are made of bronze or aluminum. An O-ring 398A is captured between plunger seal 391 and retaining nut 393. Similarly, an O-ring 398C seals between pump housing 352 and a flange of retaining nut 393.

Reciprocation of plunger 386 results in fuel being pumped into fuel line 304. Check valve 370 insures one way flow of fuel to fuel injection pump 302. As there are eight combustion chambers in the preferred embodiment, there are eight sets of the check valves 370 and fuel injection pumps 302. These check valves 370 and fuel injection pumps 302 are arranged in two vertically spaced tiers with four check valves 370 and four fuel injection pumps 302 in each tier. Check valves 370 and fuel injection pumps 302 are offset circumferentially by 45° from adjacent check valves 370 and pumps 302 on the juxtaposed tier.

Figure 31B:
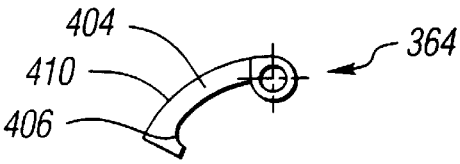
Figure 32B:
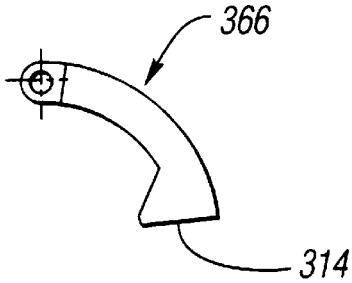
Figure 33A:
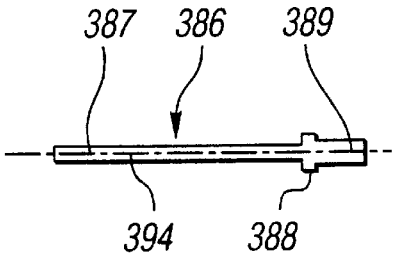
FIGS. 33A–B include side and end views of pump plunger.
Figure 33B:
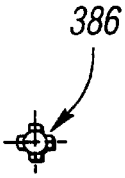

Referring to FIG. 25, reciprocation of each plunger 386 occurs as follows. A centrally located cam shaft 400 supporting an eccentric cam 402 is rotated. Shaft 400 is connected to rotate with the gear system 68 described previously. An inner rocker arm 364 which is pivotally attached to one side or the other of stationary inner rocker ring 362 pivots radially inwardly and outwardly upon rotating eccentric cam 402. As shown in FIG. 31B, rocker arm 364 includes an arcuate portion 404 having a radially inwardly extending engaging prong 406 at an end distal to its pivot. Arcuate portion 404 further includes an outer bearing surface 410.

Figure 32A:
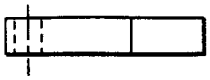
FIGS. 32A–B include top and side views of an outer rocker arm.

Outer rocker arm 366 is pivotally attached to center cam plate 356 and to either top cam plate 360 or bottom cam plate 354, depending upon whether the outer rocker arm 366 is in an upper or lower tier. In FIG. 32A, outer rocker arm 366 also has an arcuate portion 412 with a radially inwardly extending prong 314 at the end distal to its pivot. In contrast to stationary inner rocker ring 362, bottom, center and top cam plates 354, 356 and 360 are rotatable relative to pump housing 352 by a throttle lever 418, as shown in FIG. 24.

By varying the circumferential position of outer rocker arm 366 relative to its corresponding inner rocker arm 364, the amount of radial displacement of plunger 386 can be varied. As shown in full line in FIG. 25, when the pivots of inner and outer rocker arms 364 and 366 are spaced relatively circumferentially far apart, prong 314 of outer rocker arm 366 will ride upon outer bearing surface 410 of inner rocker arm 364 adjacent its prong 406. As prong 406 is located at the distal end of inner rocker arm 362, its radial displacement will be greater than any corresponding intermediate point on arcuate portion 404. In fact, the portion adjacent the pivot of inner rocker arm 364 will have virtually no radial movement as eccentric cam 402 rotates. As prong 314 of outer rocker arm 366 engages and radially moves with inner rocker arm 364 adjacent prong 406, its displacement and the displacement of plunger 386 will be at a maximum.

To reduce the amount of radial displacement of plunger 386 and, accordingly, the volume of fuel pumped per plunger stroke, the pivot of outer rocker arm 366 is rotated toward the fixed pivot of inner rocker arm 364. This positioning is shown in dashed or phantom lines. In this relative position, prong 314 of rocker arm 366 will abuttingly engage outer bearing surface 410 of inner rocker arm 362 adjacent its fixed pivot. Accordingly, there will be very little radial movement on the outer bearing surface 410 of outer rocker arm 366 upon which plunger 386 rides.

Therefore, circumferentially spacing the pivots of inner and outer rockers arms 362 and 366 far apart will result in large radial displacements of plunger 386 corresponding to relatively large quantities of fuel being pumped by each stoke of fuel injection pump 302. Conversely, rotating the pivots of respective inner and outer rocker arms 364 and 366 closer together results in less fuel being pumped per stoke. This corresponds to a slow or idling engine speed.

In FIG. 24, inner rocker arms 364 are arranged in a stacked two tier arrangement. Press fit into four bores 424 of pump housing 352 are four lower pins 426. Pivotally mounted on pins 426 are four lower inner rocker arms 364. Stationary inner rocker ring 362 (see FIG. 30) has lower receiving recesses 427 which are press fit over lower pins 426. On the upper surface of inner rocker ring 362 are four receiving recesses 429 which receive upper pins 430. An upper tier of inner rocker arms 364 are pivotally mounted on pins 430.

Next, positioned radially outside of inner rocker ring 362 are rotatable bottom, center and top cam plates 354, 356 and 360. Lower and upper pins 432 and 434 extend respectively between bottom and center plates 354 and 356 and between center and upper plates 356 and 360. Bushings 436 surround pins 432 and 434. Space plates 354, 456 and 360 are sufficiently apart such that lower and upper tiers of outer rocker arms 366 are not pinched.

Figure 27A:
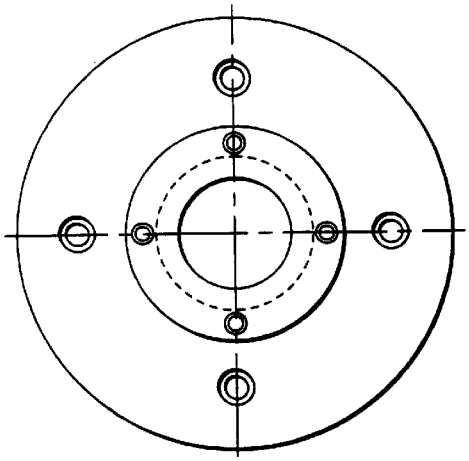
FIGS. 27A–B includes top and side views of a top cam plate.
Figure 28A:
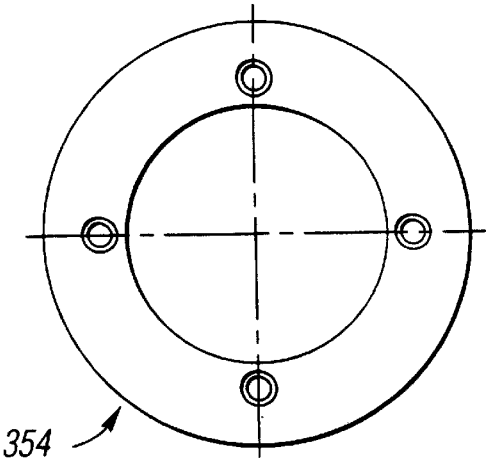
FIGS. 28A–B include top and side views of a bottom cam plate.
Figure 27B:
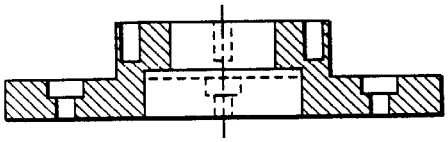
Figure 28B:
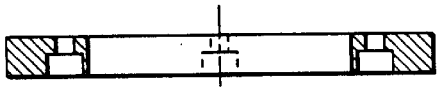
Figure 29A:
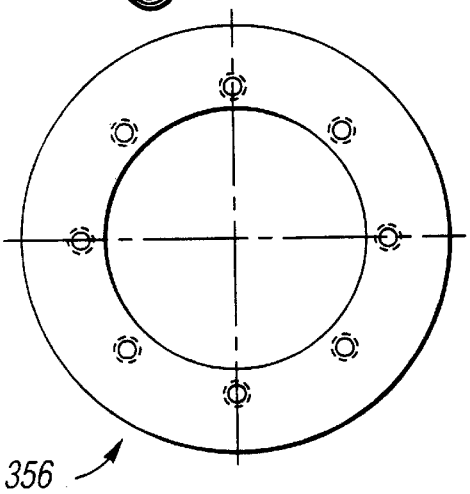
FIGS. 29A–B include top and side views of a center cam plate.
Figure 29B:
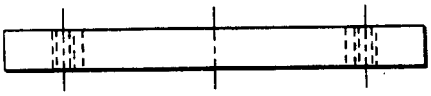
Figure 30:
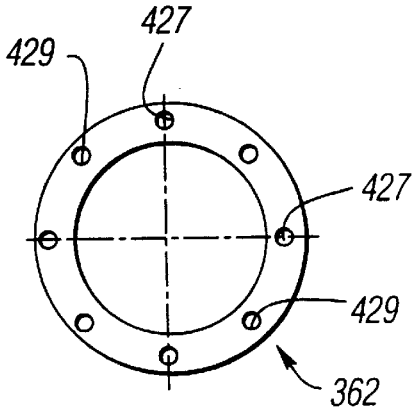
FIG. 30 is a top view of an inner rocker ring.
Figure 31A:
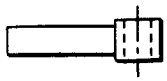
FIGS. 31A–B include top and side views of an inner rocker arm.

In FIGS. 27, 28 and 29, top and bottom cam plates 360 and 354 have four holes therethrough. Cam plates and center cam plate 356 have eight threaded apertures. As shown in FIG. 24, upper and lower annular rocker chambers 440 and 442 are created by these spaced apart cam plates in which inner and outer rocker arms 364 and 366 pivot.

A pair of spaced apart ball bearings 446 and seals 450 are located about cam shaft 400. Central cavity 368, in which inner rocker ring 362 and cam plates 354, 356 and 360 reside, is filled with oil to lubricate the moving rocker arms 364 and 366 and also bearings 446. Seals 450 prevent the oil from leaking from chamber 368. Cover plate 358 and O-rings 379 assist in sealing central cavity 368.

Figure 36:
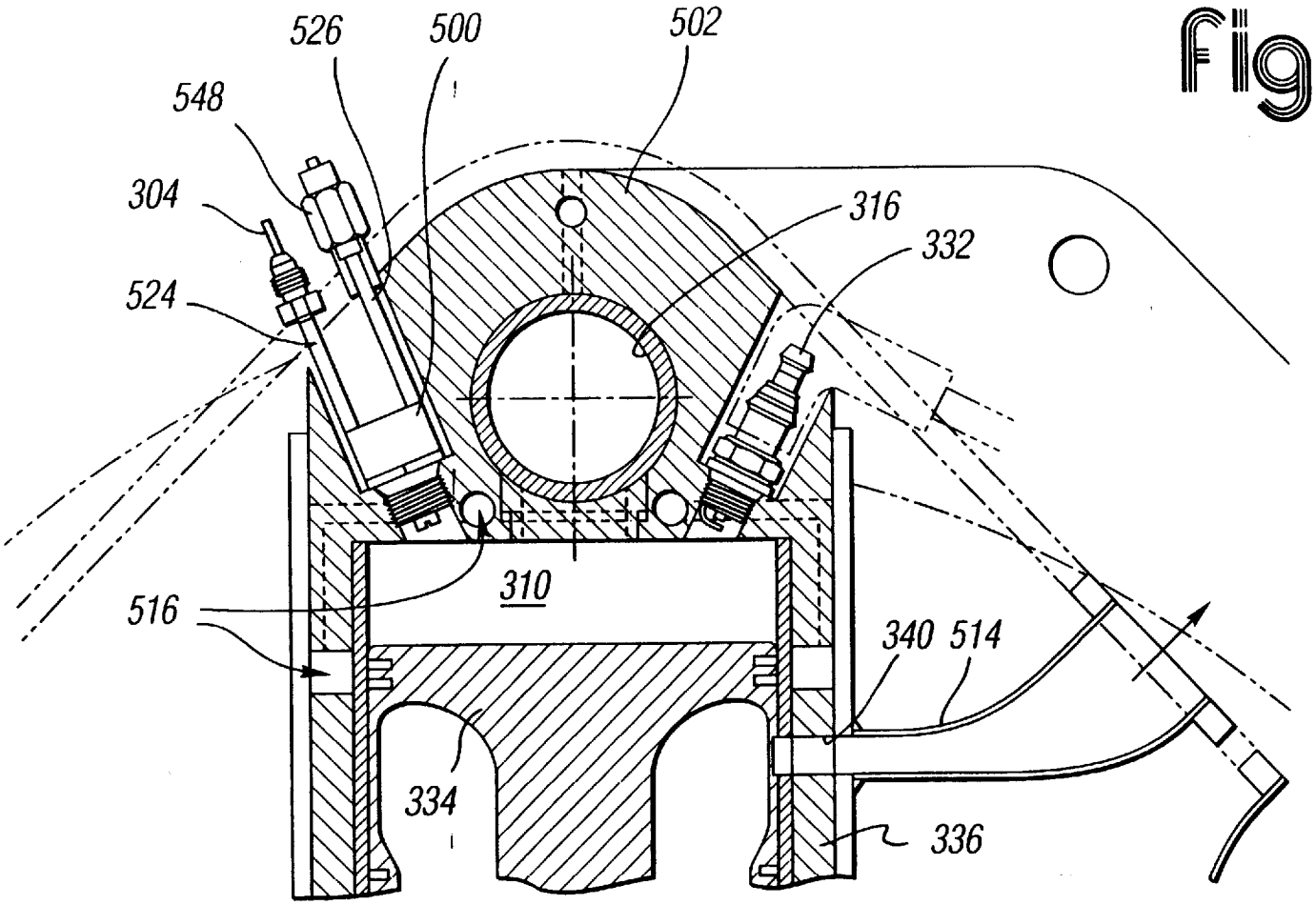
FIG. 36 is a fragmentary sectional view of a cylinder head and fuel injector.

FIG. 36 shows an improved fuel injector 500 threadedly mounted within a cylinder head 502 to provide fuel to combustion chamber 310. Also shown is a piston 334 which reciprocates within a cylinder 336. Exhaust port 340 in cylinder 336 is in communication with an exhaust conduit 514 to release burned gases from the rotary engine 300. Rotary valve 316 provides supercharged air to combustion chamber 310. A water jacket 516 is provided to cool rotary engine 300. Spark plug 332 provides spark to the combustion chamber 310 to ignite fuel. Spark plug 332 connects to ignition coil pack 322 which, in turn, is connected to the ignition distributor 326.

Figure 37B:
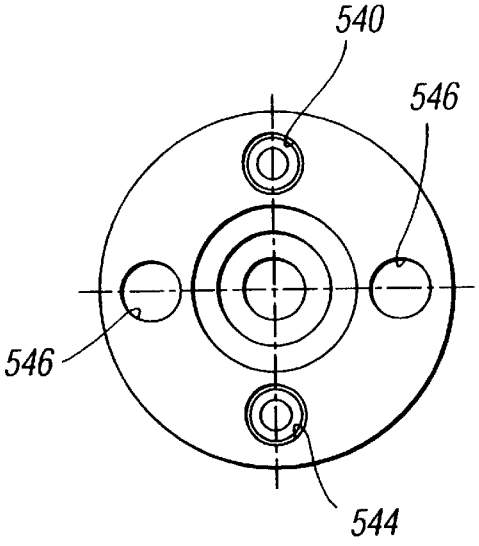
FIGS. 37A–B include sectional and end views of the fuel injector of FIG. 34.
Figure 37A:
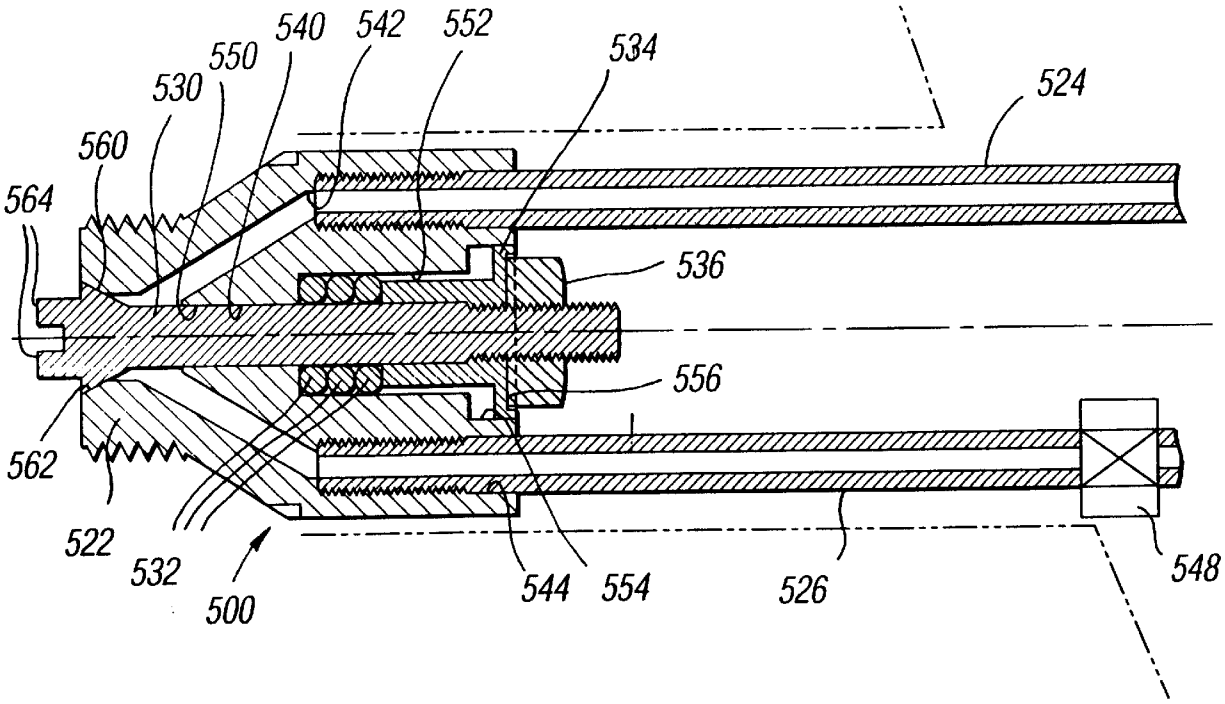

Turning now to FIGS. 37A–B, fuel injector 500 is shown in greater detail. Fuel injector 500 comprises an outer housing 522, an injector plunger 530, a plurality of O-rings 532, a spacer 534 and an adjustment nut 536. Inlet conduit 524 and bleeder conduit 526 may be fluidly connected to housing 522 as shown in FIG. 36.

Housing 522 has a stepped central bore 540, an inlet bore 542, a bleeder bore 544 and a pair of spanner holes 546. The spanner holes 546 cooperate with a pronged tool (not shown) for screwing fuel injector 500 into cylinder head 502. Inlet conduit 524 connects between a fuel line 304 and inlet bore 542. Accordingly, fuel passes through fuel line 304, inlet conduit 524 and inner bore 542 to reach central bore 540. Bleeder conduit 526 has a valve 548 connected at its end, which can be opened and closed to bleed unwanted air from fuel injector 500.

Central bore 540 has a plunger bore portion 550, an O-ring bore portion 552 and a flange bore portion 554 sized to receive injection plunger 530, O-rings 532 and a flange 556 on spacer 534. In this preferred embodiment, three elastomeric O-rings 532 are used as seals to prevent fuel from passing through central bore 540 about plunger 530. The seals also act as a spring to bias plunger 534 sealingly closed against housing 522. The amount of this bias can be controlled by varying adjustment nut 536 to alter the amount of compression on O-rings 532 between outer housing 522 and spacer 534. Adjustment nut 536 is threadedly engageable with injection plunger 530 so that variable compression adjustment can be made.

At the far end of injection plunger 530 is a generally frustoconical bearing portion or valve seat 560 which mates with a corresponding flared bearing portion 562 formed in central bore 540. Affixed on the end of injection plunger 530 is a heater plug 564.

In operation, surges of fuel pressure from the injection pump 302 are sufficient to press upon an exposed portion of bearing portion 560, overcoming the closing bias of O-rings 532 on injection plunger 530. A small annular opening then forms between frustoconical bearing portion 560 and flared bearing portion 562 of housing 522. Fuel is sprayed through this opening in a cone shaped pattern, dispersing the fuel into a very fine mist. Heater plug 564 keeps the tip of the injector plunger 430 sufficiently hot to gasify fuel as the previously liquified fuel escapes under pressure. Multiple fuels, such as gasoline or diesel fuel, may therefore be used with rotary engine 300 due to the gasification of the fuels.

A second embodiment of a combination spark plug/fuel injector 600 is shown in FIGS. 39 and 40. Fuel injector 600 is an assembly of components including a metal injector valve 602, a phenolic spacer washer 604, an outer housing 606, an annular metallic retainer ring 610, a ceramic liner 612 and a conventional spark plug connector 614.

Outer housing 606 has a stepped central bore 616, an inlet bore 620, a bleeder bore 622 and a pair of spanner holes 624. External threads are provided so that fuel injector 600 may be threaded into cylinder head 502.

Injector valve 602 has an elongated body 626 having a hollow internal threaded portion 630 at a first end and at a second end a frustoconical bearing portion or valve seat 632. Valve seat 632 is separated by an annular groove 634 from an annular spark ring 636. Spark plug wire connector 614 is threadedly attached to hollow threaded portion 630.

Ceramic liner 612 has an inlet bore 640 and a bleeder bore 642 extending therethrough. The outer periphery of ceramic liner 612 is sized and configured to be slidably received within the larger diameter portion of central bore 616 of housing 606. A shoulder 644 on ceramic liner 612 and a shoulder 646 on housing 612 cooperating as stops. Ceramic liner 612 is electrically non-conductive or an insulator.

Annular retaining ring 610 has a thickened wall section 650 connected to a thinned tubular portion 652. At an opposite end is a radially inwardly extending rim 654. Retaining ring 610 is metallic and is electrically conductive.

To assemble fuel injector 600, ceramic liner 612 is slid into the left end, as shown in FIG. 39A, of housing 606. The corresponding inlet and bleeder bores 620, 622 and 640, 642 are coaxially aligned to permit fluid flow therebetween. Next, retainer ring 610 is press fit into central bore 616 as seen in FIG. 39A to hold ceramic liner 612 in place. A spark gap 660 is established between spark ring 636 on injector valve 602 and rim 654 on retainer ring 610, as seen in FIG. 39A.

Injector valve 602 is passed through central bore 639 of ceramic liner 612 with bearing portion 632 on injector valve 602 mating with bearing portion 639 on ceramic liner 612. Phenolic spacer washer 604 is slid over injector valve 602. Finally, spark plug wire connector 640 is threadedly fastened to injector valve 602. Again, O-rings are provided for sealing between injector valve 602 and inner bore 639 of ceramic liner 612 and to bias the bearing portions 639 and 632 together. Threadedly adjusting the engagement between spark plug wire connector 638 and injector valve 602 controls the fuel fluid pressure needed to separate bearing portions 639 and 632 to produce an annular opening for conically spraying fuel into combustion chamber 502.

Fuel line 304 is connected to inlet bore 620 and a bleeder conduit (not shown) is connected to bleeder bore 622 to allow trapped air to be removed from fuel injector 600. Spark plug wire connector 614 is connected to ignition coil pack 422, which is controlled by ignition distributor 426. Current reaching connector 614 passes down injector valve 602 and reaches spark ring 636. This causes a short and spark to occur across spark gap 660, thereby igniting fuel in combustion chamber 310.

Accordingly, fuel injector 600 serves both as a fuel injector and as a spark plug. Consequently, the spark plug opening in FIG. 36 could be sealed off with a plug while fuel injector 600 replaces fuel injector 500 and spark plug 332.

FIG. 41 shows a valve or piston timing schematic. Preferably, when piston 334 is at top dead center in its cylinder 336, a spark is provided to explode the gases within combustion chamber 310. Piston 334 will move downwardly with combustion chamber 310 expanding. After displacing sufficiently, exhaust port 340 will be opened. Prior to reaching bottom dead center, air is supported by rotary valve 316 to flush out the spent exhaust gases.

Piston 334 will reach bottom dead center and then begin its return stroke, contracting combustion chamber 310. Exhaust port 340 will close when piston 334 is sufficiently returned. Soon thereafter, fuel is injected in combustion chamber 310 along with air. Rotary valve 316 then closes as fuel continues to be injected. Finally, fuel injector is closed just prior to ignition. Piston 334 continues to contract combustion chamber 310 until nearly reaching top dead center at which time a spark is again introduced to ignite the compressed air and gaseous fuel mixture.

While the best modes for carrying out the invention have been described in detail, those familiar with the art to which the invention relates will recognize various alternative designs and embodiments for practicing the invention as defined by the following claims.

What is claimed is:

1. In an internal combustion engine having a crankshaft, an improvement including a rotary fuel pump and fuel injector assembly for receiving and pumping fuel into an engine cylinder of the internal combustion engine, the assembly comprising:

a rotatable camshaft mechanically coupled with the crankshaft and having an eccentric cam thereon;

a first rocker arm pivotally mounted relative to and following the eccentric cam as the cam rotates;

a cylinder having a fuel bore for receiving fuel and a fuel pump plunger bore in fluid communication with the fuel bore;

a fuel pump plunger slidably mounted in the fuel pump plunger bore and actuated by the rocker arm to reciprocate within the fuel pump plunger bore;

the fuel injector assembly being in fluid communication with the plunger bore, the fuel injector assembly including a housing having a housing plunger bore and an inlet bore in fluid communication with the housing plunger bore, the housing having a valve seat disposed thereon;

a fuel injector plunger which reciprocates within the housing plunger bore and having a valve seat;

sealing biasing means for biasing the valve seat of the plunger against the valve seat of the housing to seal one end of the housing plunger bore; and a bleed bore and a bleeder valve, the bleed bore being in communication with the inlet bore to allow air to bleed from the housing upon the bleeder valve opening;

wherein when the camshaft is rotated, the first rocker arm pivots, causing the plunger to reciprocate and pump fuel from the plunger bore to the fuel injector assembly and into the engine cylinder.

2. In an internal combustion engine having a crankshaft, an improvement including a rotary fuel pump and fuel injector assembly for receiving and pumping fuel into an engine cylinder of the internal combustion engine, the assembly comprising:

a rotatable camshaft mechanically coupled with the crankshaft and having an eccentric cam thereon;

a first rocker arm pivotally mounted relative to and following the eccentric cam as the cam rotates;

a cylinder having a fuel bore for receiving fuel and a fuel pump plunger bore in fluid communication with the fuel bore;

a fuel pump plunger slidably mounted in the fuel pump plunger bore and actuated by the rocker arm to reciprocate within the fuel pump plunger bore to pump surges of fuel therefrom to the fuel injector assembly;

the fuel injector assembly being in fluid communication with the fuel bore and the engine cylinder, and including:

a fuel injector housing having a housing plunger bore and an inlet bore in fluid communication with the housing plunger bore, the housing having a valve seat disposed thereon;

a fluid injector plunger reciprocating within the housing plunger bore and having a valve seat; and sealing biasing means for biasing the valve seat of the fuel injector plunger against the valve seat of the housing to seal one end of the housing plunger bore;

wherein when the inlet bore of the housing receives fuel under sufficient pressure from the fuel pump, the fuel urges the fuel injector plunger to overcome the sealing biasing means so that the valve seats separate and allow fuel to escape therebetween from the plunger bore and into the engine cylinder, and the plunger valve seat seats against the housing valve seat in response to fluid pressure from the engine cylinder; and the biasing means including at least one elastomeric O-ring interposed between the fuel injector plunger and the housing of the fuel injector assembly.

3. The assembly of claim 2 wherein:

the O-ring seals between the fuel injector plunger and the housing plunger bore of the fuel injector assembly.

4. In an internal combustion engine having a fuel pump, an improved fuel injector assembly for receiving fuel under pressure from the fuel pump, and a combustion chamber for burning fuel, the improved fuel injector assembly comprising:

a fuel injector housing having a plunger bore in communication with the fuel pump and having a valve seat in communication with the combustion chamber;

a plunger which reciprocates within the plunger bore, the plunger including a valve seat which seats relative to the valve seat of the fuel injector housing in response to alternating fuel pressure exerted by the fuel pump, the plunger having a proximate end exposed to the combustion chamber;

sealing biasing means for biasing the plunger valve seat against the fuel injector housing valve seat;

wherein the valve seats unseat relative to one another in response to fuel at a sufficient pressure from the fuel pump acting on the plunger and the valve seats seat in response to biasing from the sealing biasing means and in response to the pressure from the combustion chamber upon the proximate end of the plunger, thereby preventing back flow from the combustion chamber into the fuel injector assembly, so that fuel regulation is performed by the fuel pump and so that the valve seat serves as a back flow check valve for the pump.

5. The fuel injector assembly of claim 4 wherein:

the fuel injector housing includes a fuel bore in communication with the plunger bore.

6. The fuel injector assembly of claim 4 wherein:

the housing valve seat is generally frustoconical whereby a conical spray of fuel is introduced into the combustion chamber from the plunger bore.

7. In an internal combustion engine having a crankshaft, an improvement including a rotary fuel pump and fuel injector assembly for receiving and pumping fuel into an engine cylinder of the internal combustion engine, the assembly comprising:

a rotatable camshaft mechanically coupled with the crankshaft and having an eccentric cam thereon;

a first rocker arm pivotally mounted relative to and following the eccentric cam as the cam rotates;

a cylinder having a fuel bore for receiving fuel and a fuel pump plunger bore in fluid communication with the fuel bore;

a fuel pump plunger slidably mounted in the fuel pump plunger bore and actuated by the rocker arm to reciprocate within the fuel pump plunger bore to pump surges of fuel therefrom to the fuel injector assembly;

the fuel injector assembly being in fluid communication with the fuel bore and the engine cylinder, and including:

a fuel injector housing having a housing plunger bore and an inlet bore in fluid communication with the housing plunger bore, the housing having a valve seat disposed thereon;

a fluid injector plunger reciprocating within the housing plunger bore and having a valve seat; and sealing biasing means for biasing the valve seat of the fuel injector plunger against the valve seat of the housing to seal one end of the housing plunger bore;

wherein when the inlet bore of the housing receives fuel under sufficient pressure from the fuel pump, the fuel urges the fuel injector plunger to overcome the sealing biasing means so that the valve seats separate and allow fuel to escape therebetween from the plunger bore and into the engine cylinder, and the plunger valve seat seats against the housing valve seat in response to fluid pressure from the engine cylinder.

8. The assembly of claim 7 further comprising:

a fuel conduit connecting the fuel pump plunger bore and the fuel injector assembly.

9. The assembly of claim 7 further comprising:

a second rocker arm pivotally mounted with respect to the camshaft and located intermediate the first rocker arm and the fuel pump plunger such that the eccentric cam drives the first rocker arm which in turn drives second rocker arm and the fuel pump plunger.

10. The assembly of claim 9 wherein:

each of the rocker arms is provided with a pivot pin translatable relative to one another to vary the stroke and the fuel displaced by the fuel pump plunger.

11. The assembly of claim 10 further comprising:

a rotatable plate rotatable mounted relative to the camshaft, the second plunger arm pivotally mounting on the rotatable plate, the rotatable plate being rotatable about the camshaft to move the pivot pins relative to one another thereby varying the stroke of the fuel pump plunger.

* * * * *